US006025817A

United States Patent [19]

Uno et al.

[11] Patent Number: 6,025,817

[45] Date of Patent: Feb. 15, 2000

[54] LIQUID CRYSTAL DISPLAY SYSTEM USING A DIGITAL-TO-ANALOG CONVERTER

[75] Inventors: Takaaki Uno, Ikoma-gun; Shinji Horino, Nara; Yasuhiro Hirayama, Osaka; Yukihiro Mizumoto, Kitakatsuragi-gun, all of Japan

[73] Assignee: Sharp Kabushiki Kaisha, Osaka, Japan

[21] Appl. No.: 08/691,529

[22] Filed: Aug. 2, 1996

[30] Foreign Application Priority Data

Aug. 3, 1995 [JP] Japan ..... 7-198747

[51] Int. Cl.[7] ..... G09G 5/00; G09G 3/36

[52] U.S. Cl. ..... 345/1; 345/87; 345/204

[58] Field of Search ..... 395/89, 100, 99, 395/87, 98, 213, 112, 127, 132, 202, 96, 204, 1, 3; 348/438, 521, 536, 211

[56] References Cited

U.S. PATENT DOCUMENTS

| | | | |
|---|---|---|---|
| 4,181,971 | 1/1980 | Frey et al. | 345/112 |
| 4,393,405 | 7/1983 | Ikeda | 348/536 |
| 4,429,327 | 1/1984 | Oakley et al. | 348/438 |
| 5,103,219 | 4/1992 | Kemner et al. | 345/211 |
| 5,119,084 | 6/1992 | Kawamura et al. | 345/98 |
| 5,151,690 | 9/1992 | Yamazaki | 345/96 |
| 5,251,051 | 10/1993 | Fujiyoshi et al. | 345/100 |
| 5,406,308 | 4/1995 | Shiki | 345/127 |
| 5,453,757 | 9/1995 | Date et al. | 345/89 |
| 5,479,073 | 12/1995 | Mamiya et al. | 345/100 |
| 5,648,791 | 7/1997 | Date et al. | 345/89 |
| 5,686,968 | 11/1997 | Ujiie et al. | 348/521 |

FOREIGN PATENT DOCUMENTS 7-110667 4/1995 Japan .

*Primary Examiner*—Jeffery Brier
*Assistant Examiner*—Paul A. Bell
*Attorney, Agent, or Firm*—Nixon & Vanderhye P.C.

[57] ABSTRACT

A liquid crystal display system of the present invention includes: an operation processing apparatus having a digital-analog converter converting a digital video signal to an analog video signal based on predetermined time information and a synchronization combining circuit superimposing the predetermined time information on at least one of a horizontal synchronizing signal and a vertical synchronizing signal; and a liquid crystal display apparatus converting the analog video signal to a digital video signal based on the predetermined time information, thereby displaying an image based on the converted digital video signal.

8 Claims, 19 Drawing Sheets

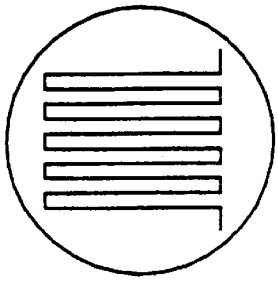
FIG. 16A
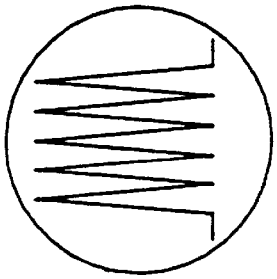
FIG. 16B
FIG. 16
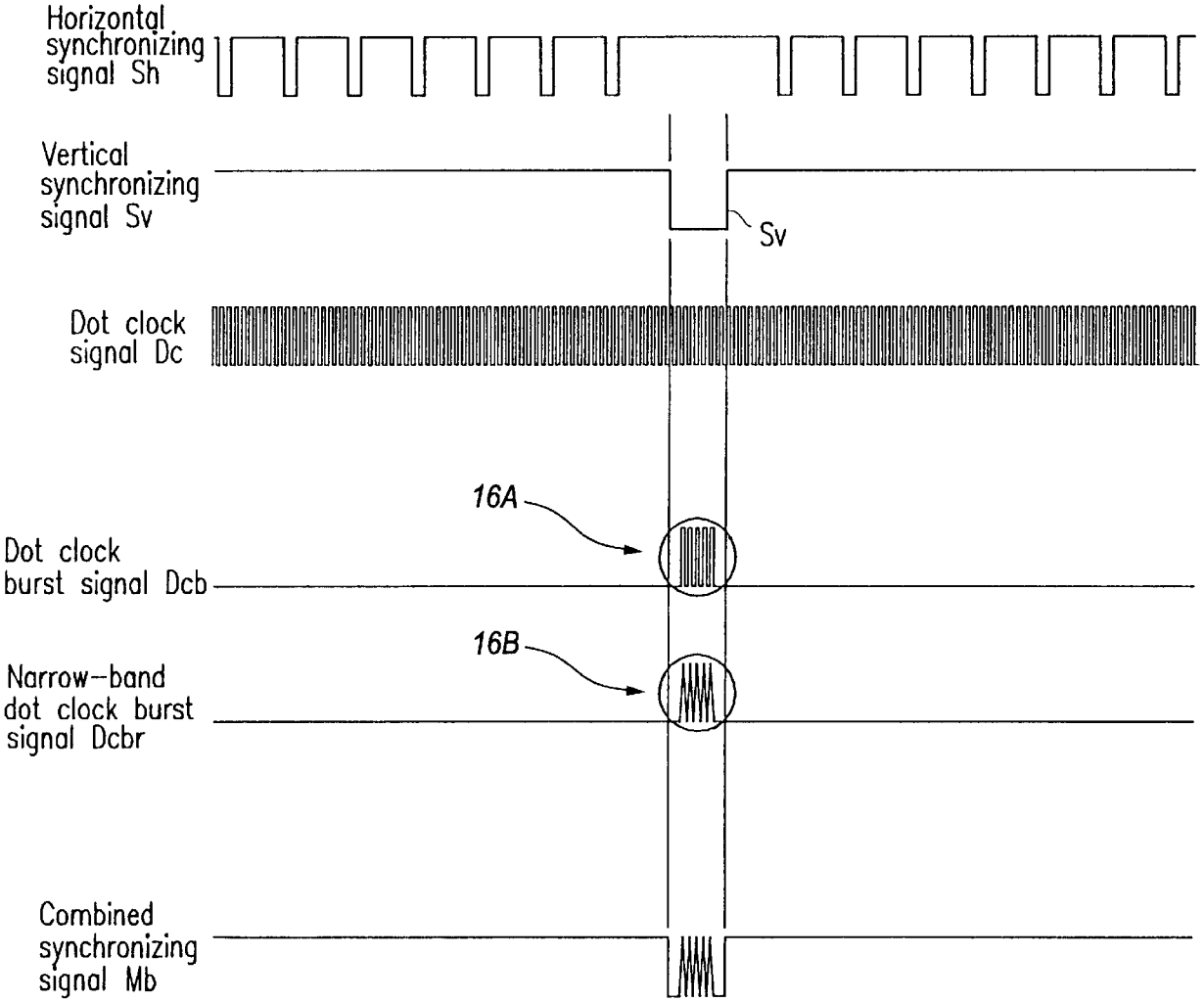

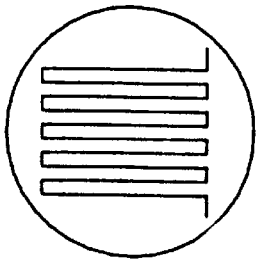
FIG. 18A
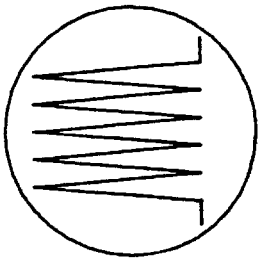
FIG. 18B
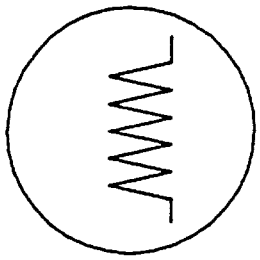
FIG. 18C
FIG. 18
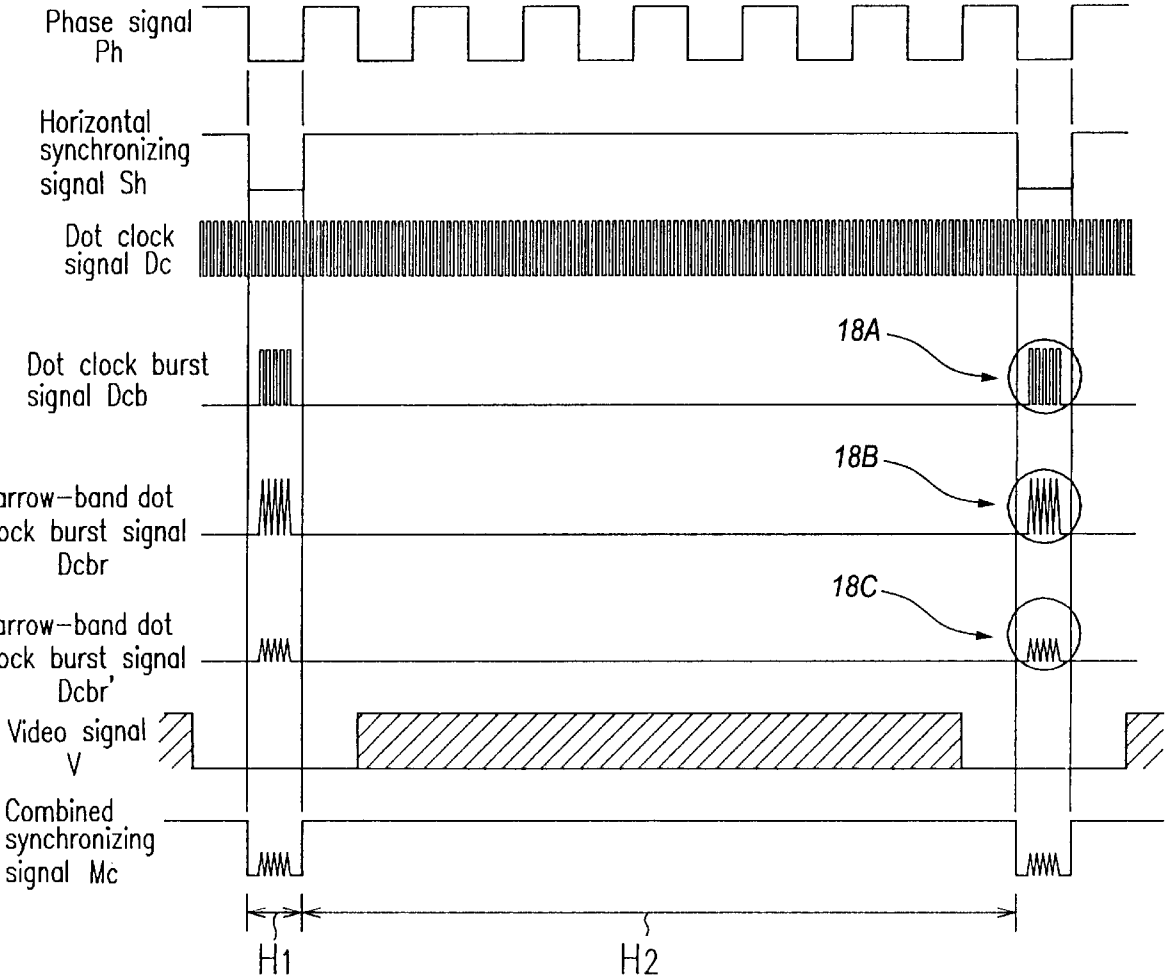

LIQUID CRYSTAL DISPLAY SYSTEM USING A DIGITAL-TO-ANALOG CONVERTER

BACKGROUND OF THE INVENTION

1. Field of the Invention

The present invention relates to a liquid crystal display system. In particular, the present invention relates to a liquid crystal display system displaying a color video signal from a personal computer (hereinafter, referred to as a PC) as an image on a high definition liquid crystal display panel. The system suppresses jitter and the like on a display screen caused by the phase shift between a video signal and a synchronizing signal, and the fluctuations of the synchronizing signal; thereby enabling a stable and clear image to be displayed.

2. Description of the Related Art

Processors such as PCs generally use cathode ray tubes (CRTs) as image displays, and video display outputs from PCs are designed for the CRTs.

FIGS. 1 through 3 illustrate a PC. More specifically, FIG. 1 is a view showing an external appearance of the PC. FIG. 2 shows an internal configuration of the PC. FIG. 3 shows a configuration of a connector connecting the PC to a CRT display portion. It is noted that FIG. 3 shows a pin arrangement of a connector for the standard VGA video output standardized by VESA.

A PC 200 includes a PC main body 210 and a CRT display portion 220 displaying a video display signal from the PC main body 210 as an image. The video display output from the PC main body 210 is supplied to the CRT display portion 220 through an analog cable 230. One end of the analog cable 230 is connected to the PC main body 210 through a connector 211 and the other end thereof is connected to the CRT display portion 220.

The PC main body 210 contains a mother board 210*a* provided with an LSI chip 201 working as a central processing unit (CPU), LSI chips 202 and 203 working as a RAM and a ROM, and an LSI chip 204 working as an input and output device. The PC main body 210 also contains a video board 210*b* provided with a video signal output portion, or a video signal generating portion (not shown), outputting a video signal for displaying the content processed by the CPU. The video board 210*b* has a configuration available from makers other than PC makers. The video board 210*b* is further provided with an LSI chip 205 working as a video memory and LSI chips 206 and 207 working as signal generating portions generating a signal required for displaying an image on the CRT display portion 220.

FIG. 4 is a block diagram illustrating a circuit configuration of a video signal generating portion 20. The video signal generating portion 20 includes a video memory 21 storing digital image data, a screen display control circuit 22 reading the digital image data from the video memory 21 based on a signal from a CPU bus or a local bus, a digital-analog converting circuit (DAC) 23 converting the digital image data into video signals, and a timing signal generating circuit 24 generating various timing signals. An oscillator (not shown) in the timing signal generating circuit 24 generates a signal with a predetermined frequency.

The timing signal generating circuit 24 generates a horizontal synchronizing signal $S_h$ for horizontal synchronization of a video signal and a vertical synchronizing signal $S_v$ for vertical synchronization of the video signal. Furthermore, the timing signal generating circuit 24 is configured so as to generate a timing signal S1 for reading digital images from the video memory 21 and a timing signal S2 for digital-analog conversion. The signals $S_h$, $S_v$, S1 and S2 are generated based on the frequency of a signal generated by the oscillator of the timing signal generating circuit 24.

The video memory 21 and the circuits 22 through 24 are realized by the LSI chips 206 and 207 on the video board 210*b*. The video board 210*b* is connected to the mother board 210*a* through a socket (not shown). Three kinds of video signals $V_r$, $V_g$, and $V_b$ of red (R), green (G) and blue (B) and the horizontal synchronizing signal $S_h$ and the vertical synchronizing signal $S_v$ are output from the PC main body 210 to the CRT display portion 220 as a video display output through the connector 211 shown in FIG. 1.

In recent years, the allocation of signal pins and the like is relatively standardized. The PC 200 uses a 15-pin D-sub connector shown in FIG. 3 as the connector 211. In a display data channel 1,2 (DDC 1,2) system, 15 pins correspond to respective signals (connector for standard VGA video output). More specifically, pins 1 through 3 correspond to a video red signal, a video green signal, and a video blue signal; pins 6 through 8 correspond to a red return signal, a green return signal, and a blue return signal; pins 11, 12, 4, and 15 correspond to monitor ID bits 0, 1, 2, and 3. A pin 5 corresponds to a test signal, and a pin 10 corresponds to a synchronizing return signal. Pins 13 and 14 correspond to a horizontal synchronizing signal and a vertical synchronizing signal, respectively. The pin 9 is not connected anywhere (NC).

In the case where a video display signal from the PC main body is displayed as an image by a CRT display, a stable image can be obtained by supplying only a horizontal synchronizing signal and a vertical synchronizing signal to the CRT display as synchronizing signals.

FIG. 5 shows a system displaying a video display signal as an image by using a liquid crystal display (or a liquid crystal panel) instead of a CRT display. In this figure, the same components as those in FIG. 1 have the same reference numerals.

A video display signal is supplied from the PC main body 210 to a liquid crystal display apparatus 110 through an analog cable 130. One end of the analog cable 130 is connected to the PC main body 210 through the connector 211. The other end of the analog cable 130 is connected to the liquid crystal display apparatus 110.

A plurality of data signal lines (source lines) 115 and a plurality of scanning signal lines (gate lines) 114 are formed on the surface of a substrate of the liquid crystal display apparatus 110 in such a manner that the signal lines 115 cross the scanning lines 114. A TFT-liquid crystal display device has source lines and gate lines with an insulating layer formed therebetween on one of glass substrates, and TFTs (thin film transistors) connected to pixel electrodes are controlled by the source lines and the gate lines. A common electrode is provided on the other glass substrate via a liquid crystal layer.

The liquid crystal display apparatus 110 includes a data driver 150 for driving the data signal lines 115, a scanning driver 140 for driving the scanning signal lines 114, and a signal processing portion 120 containing a control circuit for controlling a display of the liquid crystal display apparatus 110. The liquid crystal display apparatus 110 also has pixels (or dots) at crossing portions of the data signal lines 115 and the scanning signal lines 114.

An analog-digital converter of the liquid crystal display apparatus 110 converts the video signals into digitized video data. The digitized video data is usually temporarily stored in a buffer memory. The stored video data is read to the scanning signal lines 114 and the data signal lines 115 at a given timing of a timing signal. The frequency of the timing signal is set relatively lower than that of a dot clock signal described later. This is because the flyback period required for the CRT display is not required for the liquid crystal display apparatus. In the liquid crystal display apparatus, the video signals can be displayed even during a period corresponding to the flyback period. More specifically, in the liquid crystal display apparatus, the scanning frequency can be lowered, which makes it easy to satisfy the upper limit frequency conditions of the operation of the drivers.

Furthermore, in order to relax the operation conditions of the drivers, video signals can be stored in a buffer memory divided into two systems or the like, and video signals are supplied to the drivers of the liquid crystal display apparatus from the respective systems of the buffer memory.

In the image display system having the above-mentioned structure, it is required to supply video signals precisely at a given timing to the corresponding pixel P. Therefore, in the liquid crystal display apparatus 110, a dot clock signal representing time information is generated. The dot clock signal is used as a sampling signal for conversion of the video signals by an analog-digital converter (ADC). The dot clock signal is generated only from conventional vertical and horizontal synchronizing signals, considering the compatibility with the CRT display. In general, the dot clock signal is generated by using a phase locked loop (PLL) circuit, a voltage control oscillator (VCO) circuit, and a frequency demultiplier or the like, if required.

FIG. 6 is a block diagram showing a dot clock signal generating circuit 120*a* provided in the signal processing portion 120 of the liquid crystal display apparatus 110. The dot clock signal generating circuit 120*a* generates a dot clock signal based on a horizontal synchronizing signal.

The dot clock signal generating circuit 120*a* includes a frequency demultiplier 12 demultiplying a dot clock signal $D_c$, a phase comparator 11 comparing the phase of a horizontal synchronizing signal $S_h$ with the phase of the dot clock signal $D_c$, a filter 13 receiving positive comparison output $C_p$ and a negative comparison output $C_n$ of the phase comparator 11, a capacitor 14, and a VCO 15 generating a dot clock signal $D_c$ with a frequency based on the comparison outputs $C_p$ and $C_n$. The capacitor 14 is connected to an input terminal of the VCO 15.

The dot clock signal $D_c$ is used as a sampling signal for conversion of the video signals by the ADC. The quality of an image is determined by the preciseness of a timing at which the video signals are sampled. The phase shift, fluctuations, etc. of the dot clock signal with respect to the video signal greatly affects the quality of an image of the liquid crystal display apparatus. More specifically, the phase shift, fluctuations, etc. of the dot clock signal cause blurring and flickering of displayed letters, lines and the like, or make lines look thicker, etc.; thereby greatly degrading a display quality.

Thus, it is required that the frequency and the phase of the dot clock signal be precisely matched with the frequency and the phase of the timing signal of digital-analog conversion of the digital image data on the signal generating side (i.e., on the side of the PC). In order to generate a stable dot clock signal $D_c$, as described in Japanese Laid-Open Patent Publication No. 7-110667, various alterations should be made in the clock signal generating circuit.

In a high definition liquid crystal display apparatus, the frequency of a dot clock signal is very high, i.e., 1000 to 1500 times that of a horizontal synchronizing signal. Thus, the dot clock signal generating circuit of the liquid crystal display apparatus is required to generate a dot clock signal with a stable oscillation frequency during one horizontal synchronizing period and to exactly respond to a horizontal synchronizing pulse at a high speed. Furthermore, the dot clock signal generating circuit should hold the same phase relationship between the dot clock signal and the timing signal as a sampling signal of a video signal on the PC side with high precision.

With the dot clock signal generating circuit using a PLL circuit and a VCO circuit, it is technically difficult to realize both of the stability for a long period of time and the rapid response.

In the dot clock signal generating circuit shown in FIG. 6, the oscillation frequency of the dot clock signal $D_c$ of the VCO circuit 15 is controlled with a voltage $V_c$ obtained by comparing the phase of the horizontal synchronizing signal $S_h$ with that of a demultiplied signal of the dot clock signal $D_c$.

The VCO circuit is configured in such a manner that the increase in the voltage $V_c$ results in the increase in an oscillation frequency of the circuit and the decrease in the voltage $V_c$ results in the decrease in an oscillation frequency of the circuit. When the voltage $V_c$ is stable for a longer period of time, the oscillation frequency of the VCO circuit is likely to be stabilized. It is desired that a time constant of the portion generating the voltage $V_c$ is set high in order to stabilize an oscillation frequency. In order to set the time constant high, the capacity of the capacitor 14 is increased.

However, the increase in capacity of the capacitor 14 degrades the response of the VCO circuit. For example, in the case where the PC changes a display mode to change a display state, it will take a long time for a display image to be stabilized. During this period, the display image is unsatisfactory. On the other hand, in the case where the response of the VCO circuit is improved, the stability is not maintained for a long period of time.

When the circuit as described above is actually used, in some cases the switching of the display mode on the PC side results in the change in the horizontal synchronizing frequency by about 20%. Therefore, the dot clock signal generating circuit should be designed in such a manner that the horizontal synchronizing frequency has a certain degree of allowance.

In the case where a dot clock signal is not generated on the liquid crystal display apparatus 110 side based on the horizontal synchronizing signal input from the PC side, it is required to add appropriate signal generating circuit on the PC side in order to supply a dot clock signal from the PC side. However, it is difficult to add terminals for outputting a dot clock signal under the condition that the arrangements of the connector for a signal output and an output signal terminal of the PC are determined. Furthermore, considering the compatibility of the CRT display and the liquid crystal display, it is not effective to change the horizontal synchronizing signal output from the video signal output portion of the PC so as to be suitable for the liquid crystal display.

SUMMARY OF THE INVENTION

The liquid crystal display system of this invention, includes an operation processing apparatus having a digital-analog converter converting a digital video signal to an analog video signal based on predetermined time information and a synchronization combining circuit superimposing the predetermined time information on at least one of a horizontal synchronizing signal and a vertical synchronizing signal; and a liquid crystal display apparatus converting the analog video signal to a digital video signal based on the predetermined time information, thereby displaying an image based on the converted digital video signal.

In one embodiment of the present invention, the operation processing apparatus further includes a signal generating circuit generating a dot clock burst signal.

In another embodiment of the present invention, the predetermined time information is the dot clock burst signal.

In another embodiment of the present invention, the operation processing apparatus further includes a band-limiting filter connected between the signal generating circuit and the synchronization combining circuit. The band-limiting filter receives the dot clock burst signal, filtrates the dot clock burst signal so as to limit a frequency band thereof, and outputs the dot clock burst signal with the frequency band thereof limited.

In another embodiment of the present invention, the predetermined time information is the dot clock burst signal with the frequency band thereof limited.

In another embodiment of the present invention, the band-limiting filter includes a high pass filter and a low pass filter.

In another embodiment of the present invention, the operation processing apparatus further includes an attenuator connected between the band-limiting filter and the synchronization combining circuit. The attenuator limits an amplitude of the dot clock burst signal with the frequency band thereof limited.

In another embodiment of the present invention, the predetermined time information is the dot clock burst signal with the frequency band and the amplitude thereof limited.

In another embodiment of the present invention, the operation processing apparatus further includes: a signal generating circuit generating a dot clock signal; a band-limiting filter receiving the dot clock signal, filtrating the dot clock signal so as to limit a frequency band thereof, and outputting the dot clock signal with the frequency band thereof limited; and an attenuator limiting an amplitude of the dot clock signal with the frequency band thereof limited and outputting the dot clock signal with the frequency band and the amplitude thereof limited.

In another embodiment of the present invention, the predetermined time information is the dot clock signal with the frequency band and the amplitude thereof limited.

In another embodiment of the present invention, the liquid crystal display apparatus further includes a dividing circuit extracting the predetermined time information from a signal in which the predetermined time information is superimposed on at least one of the horizontal synchronizing signal and the vertical synchronizing signal.

According to the present invention, the dot clock burst signal generated by the video signal output portion of the operation processing apparatus (PC) is supplied to the liquid crystal display apparatus after superimposition on the horizontal synchronizing signal. Therefore, it is not required to change the specification of the currently used connector provided on the PC.

Furthermore, a part of the dot clock signal generated on the PC side is supplied to the liquid crystal display apparatus. Therefore, the dot clock signal can be generated in the liquid crystal display apparatus with a simple configuration in such a manner that the timing shift of video data processing on the PC side is minimized. This enables a stable image to be easily displayed on the liquid crystal display apparatus without flickering of dots and fluctuations of a screen.

According to the present invention, the dot clock signal generated in the PC is supplied to the liquid crystal display apparatus with its frequency band limited. Therefore, the dot clock signal is transmitted almost in a sine wave, not in a pulse wave. This suppresses unwanted radiation of the clock signal with a high frequency while the signal is transmitted through a cable.

According to the present invention, the dot clock burst signal generated in the PC is transmitted in such a manner that its amplitude is limited so as not to exceed the threshold of a logical circuit set on the liquid crystal display apparatus. This suppresses unwanted radiation of the clock signal with a high frequency while the signal is transmitted through a cable.

According to the present invention, the video signal output portion is provided on the PC via a detachable video board, and the video signal output portion is configured so as to generate the dot clock signal and send the dot clock signal after superimposing it on the horizontal synchronizing signal. Therefore, the function of generating the dot clock signal and supplying it to the liquid crystal display apparatus is easily added to the currently used PC.

Since the dot clock signal is transmitted with its frequency band and amplitude limited, unwanted radiation of the dot clock signal is suppressed while the signal is transmitted through a cable.

Furthermore, the dot clock signal generated in the PC is entirely supplied to the liquid crystal display apparatus. Therefore, it is not required to generate the dot clock signal on the liquid crystal display apparatus side, and an analog video input signal can be converted into a digital video signal using the dot clock signal transmitted from the PC. Additionally, the amplitude of the dot clock signal on the PC side is limited so as not to exceed the threshold of a logical circuit set on the liquid crystal display apparatus side. Therefore, a logical circuit portion operating based on the horizontal synchronizing signal is not adversely affected by the dot clock signal superimposed on the horizontal synchronizing signal.

Thus, the invention described herein makes possible the advantage of providing a liquid crystal display system in which a signal for generating a dot clock signal is supplied to a liquid crystal panel without substantially modifying the specification of the PC side, a dot clock signal is easily generated on the liquid crystal panel side, and a display image can be obtained on the liquid crystal panel without involving flickering of dots and fluctuations of a screen.

This and other advantages of the present invention will become apparent to those skilled in the art upon reading and understanding the following detailed description with reference to the accompanying figures.

BRIEF DESCRIPTION OF THE DRAWINGS

FIG. 16 is a diagram illustrating waveforms of a vertical synchronizing signal, a dot clock signal, a dot clock burst signal, a narrow-band dot clock burst signal, and a combined synchronizing signal.

FIG. 16A is a magnified illustion of a portion of the dot clock burst signal in FIG. 16.

FIG. 16B is a magnified illustration of a portion of the narrow-band dot clock burst signal in FIG. 16.

FIG. 18 is a diagram illustrating waveforms of a video signal V and signals generated by the signal generating circuit in FIG. 18.

FIG. 18A is a magnified illustration of a portion of the dot clock burst signal in FIG. 18.

FIG. 18B is a magnified illustration of a portion of the narrow-band dot clock burst signal in FIG. 18.

FIG. 18C is a magnified illustration of a portion of the narrow-band dot clock burst signal in FIG. 18.

DESCRIPTION OF THE PREFERRED EMBODIMENTS

Hereinafter, the present invention will be described by way of illustrative examples with reference to the drawings.

EXAMPLE 1

Figure 7:
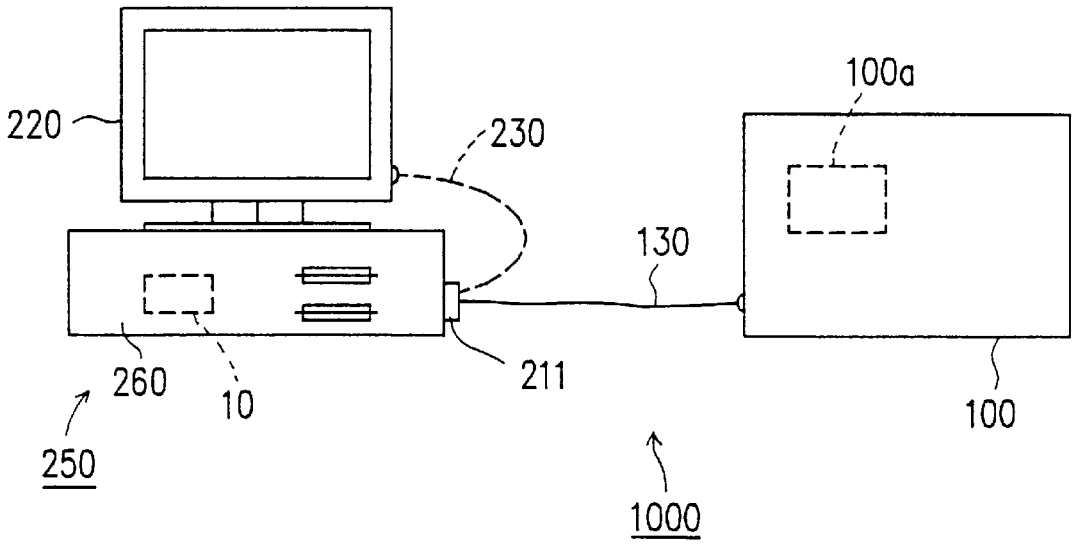
FIG. 7 is a view showing a liquid crystal display system of the present invention.

FIG. 7 is a view showing an external appearance of a liquid crystal display system 1000 in Example 1 according to the present invention. The liquid crystal display system 1000 in Example 1 includes a PC 250 and a liquid crystal display apparatus 100 displaying a video display signal from the PC 250 as an image. A PC main body 260 is connected to a CRT display 220 through an analog cable 230.

In the PC main body 260 in Example 1, a video signal output portion (not shown) superimposes a dot clock burst signal, representing time information required for converting analog video signals $V_r$, $V_g$, and $V_b$ (collectively referred to as an analog video signal V) output from the PC 250 to a digital video signal, on a horizontal synchronizing signal or a vertical synchronizing signal. Then, the video signal output portion outputs a superimposed combined synchronizing signal.

Figure 11:
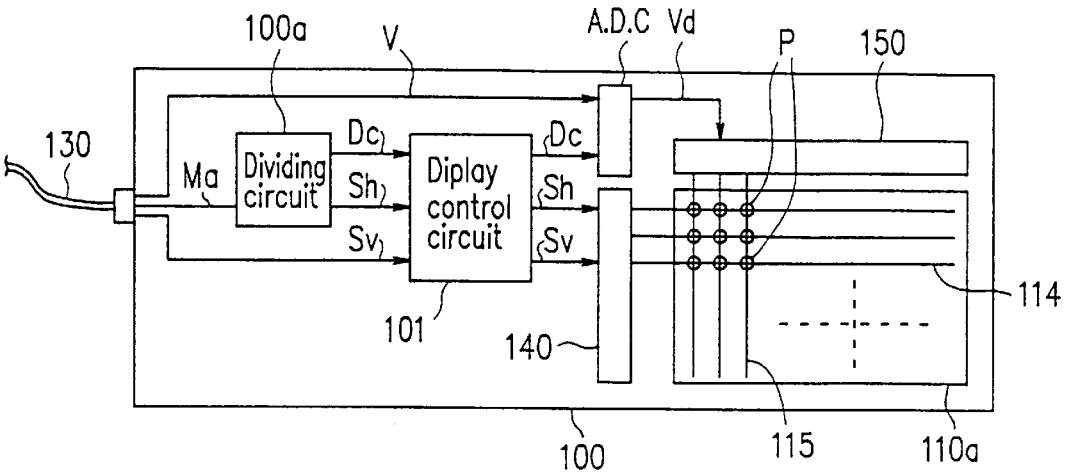
FIG. 11 is a diagram illustrating a configuration of a liquid crystal display apparatus used in the liquid crystal display system.
Figure 12:
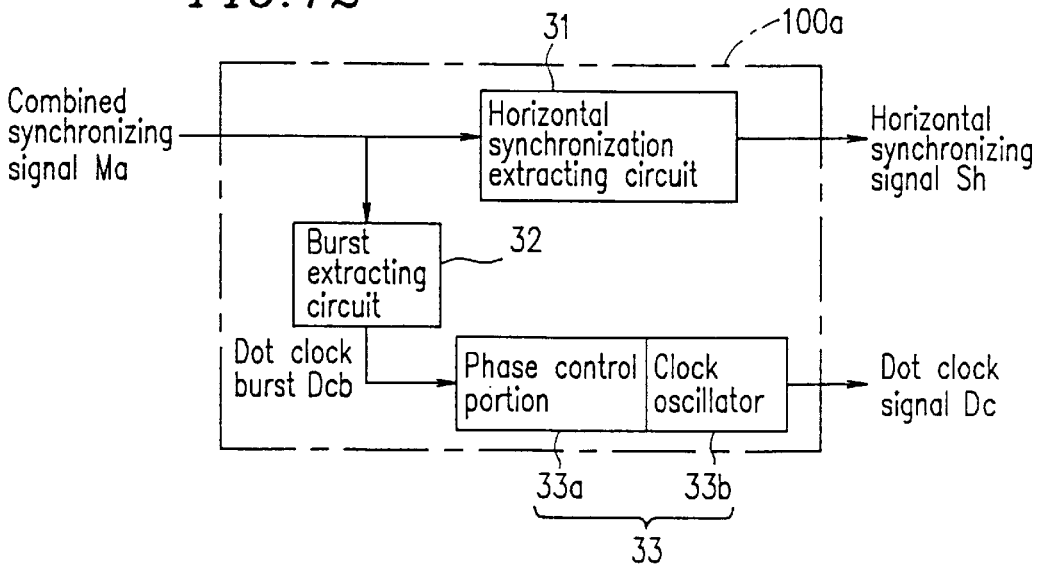
FIG. 12 is a block diagram illustrating a specific configuration of a dividing circuit in the liquid crystal display apparatus in FIG. 11.

A liquid crystal display apparatus 100 is provided with a dividing circuit 100*a* dividing a combined synchronizing signal into the horizontal synchronizing signal (or the vertical synchronizing signal) and a dot clock burst signal to provide a dot clock signal, in place of the dividing circuit 100*a* shown in FIGS. 11 and 12.

Figure 8:
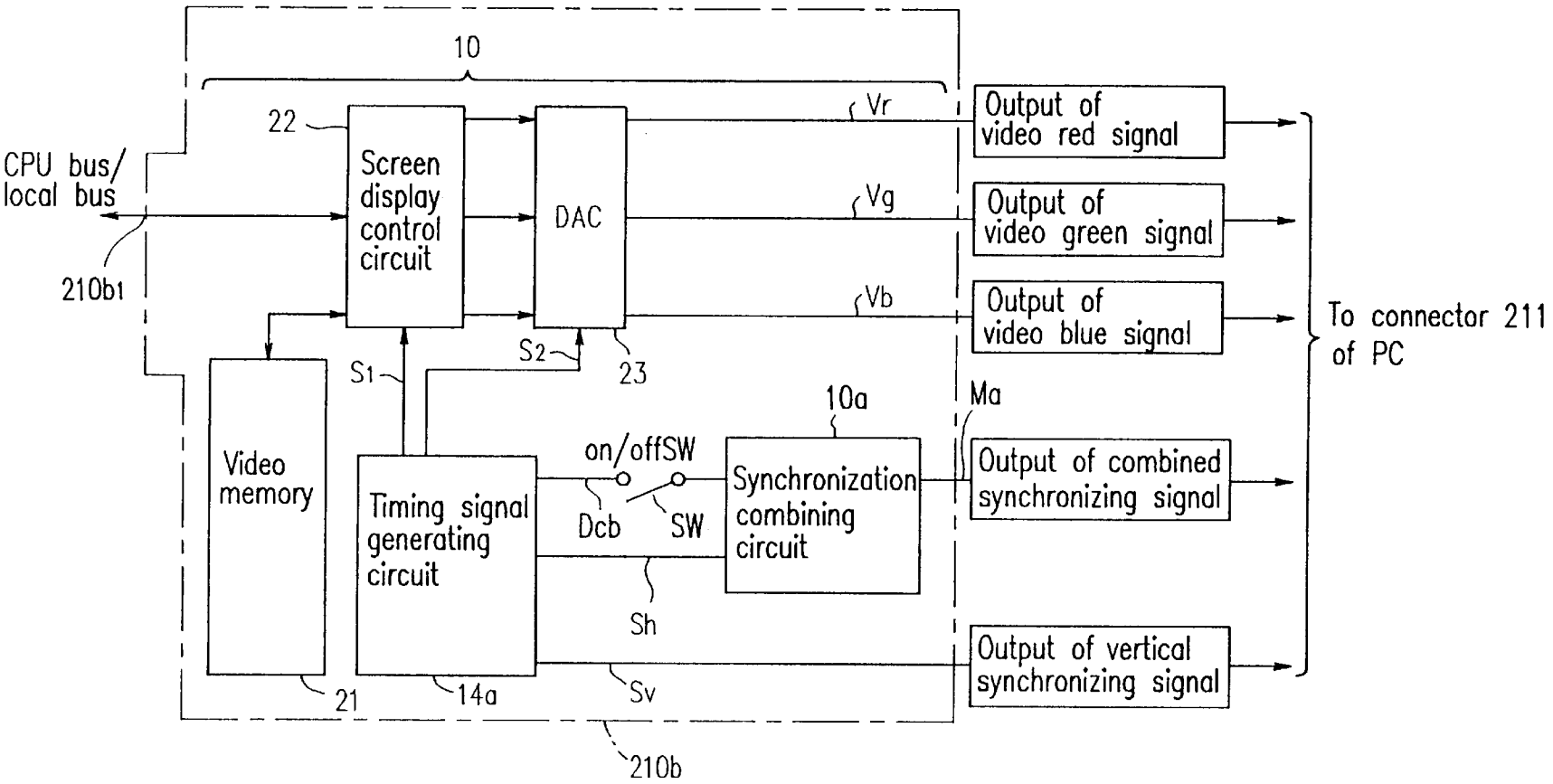
FIG. 8 is a block diagram illustrating a video signal output portion of a PC main body used in the liquid crystal display system.

Hereinafter, the configuration of the video signal output portion provided in the PC 250 shown in FIG. 7 will be described with reference to FIG. 8. FIG. 8 is a block diagram showing a configuration of the video signal output portion.

The video signal output portion 10 includes a synchronization combining circuit 10*a*, a timing signal generating circuit 14*a*, a video memory 21, a screen display control circuit 22, and a digital-analog converter (DAC) 23.

The timing signal generating circuit 14*a* supplies timing signals S1 and S2 to the screen display control circuit 22 and the DAC 23, respectively. Furthermore, the timing signal generating circuit 14*a* generates and outputs a horizontal synchronizing signal $S_h$, a vertical synchronizing signal $S_v$, and a dot clock burst signal $D_{cb}$.

The timing signals S1 and S2 have almost the same frequencies as that of a dot clock signal $D_c$ (described later). The horizontal synchronizing signal $S_h$ and the vertical synchronizing signal $S_v$ demultiply a signal output from a source clock signal oscillating circuit by predetermined values, respectively.

For example, in the case where the CRT display complies with the VGA standard, the frequency of the horizontal synchronizing signal $S_h$ is slightly smaller than the frequency obtained by dividing the frequency of the dot clock signal $D_c$ by 640. The frequency of the vertical synchronizing signal $S_v$ is slightly smaller than the frequency obtained by dividing the frequency of the dot clock signal $D_c$ by 480.

In the case where the CRT display complies with the SVGA standard, the frequency of the horizontal synchronizing signal $S_h$ is slightly smaller than the frequency obtained by dividing the frequency of the dot clock signal $D_c$ by 800. The frequency of the vertical synchronizing signal $S_v$ is slightly smaller than the frequency obtained by dividing the frequency of the dot clock signal $D_c$ by 600.

In the case where the CRT display complies with the XGA standard, the frequency of the horizontal synchronizing signal $S_h$ is slightly smaller than the frequency obtained by dividing the frequency of the dot clock signal $D_c$ by 1024. The frequency of the vertical synchronizing signal $S_v$ is slightly smaller than the frequency obtained by dividing the frequency of the dot clock signal $D_c$ by 768.

The screen display control circuit 22 is connected to a CPU bus and/or local bus. The screen display control circuit 22 receives a display control command through the CPU bus and/or local bus. The screen display control circuit 22 outputs digital image data from the video memory 21 to the DAC 23 in accordance with the timing signal S1 from the timing signal generating circuit 14*a*. The number of bits of digital image data output from the video memory 21 varies depending upon the configuration of the video memory 21. For example, the number of bits of digital image data output from the video memory 21 may be 8 bits or 16 bits depending upon the configuration of the video memory 21.

Figure 9:
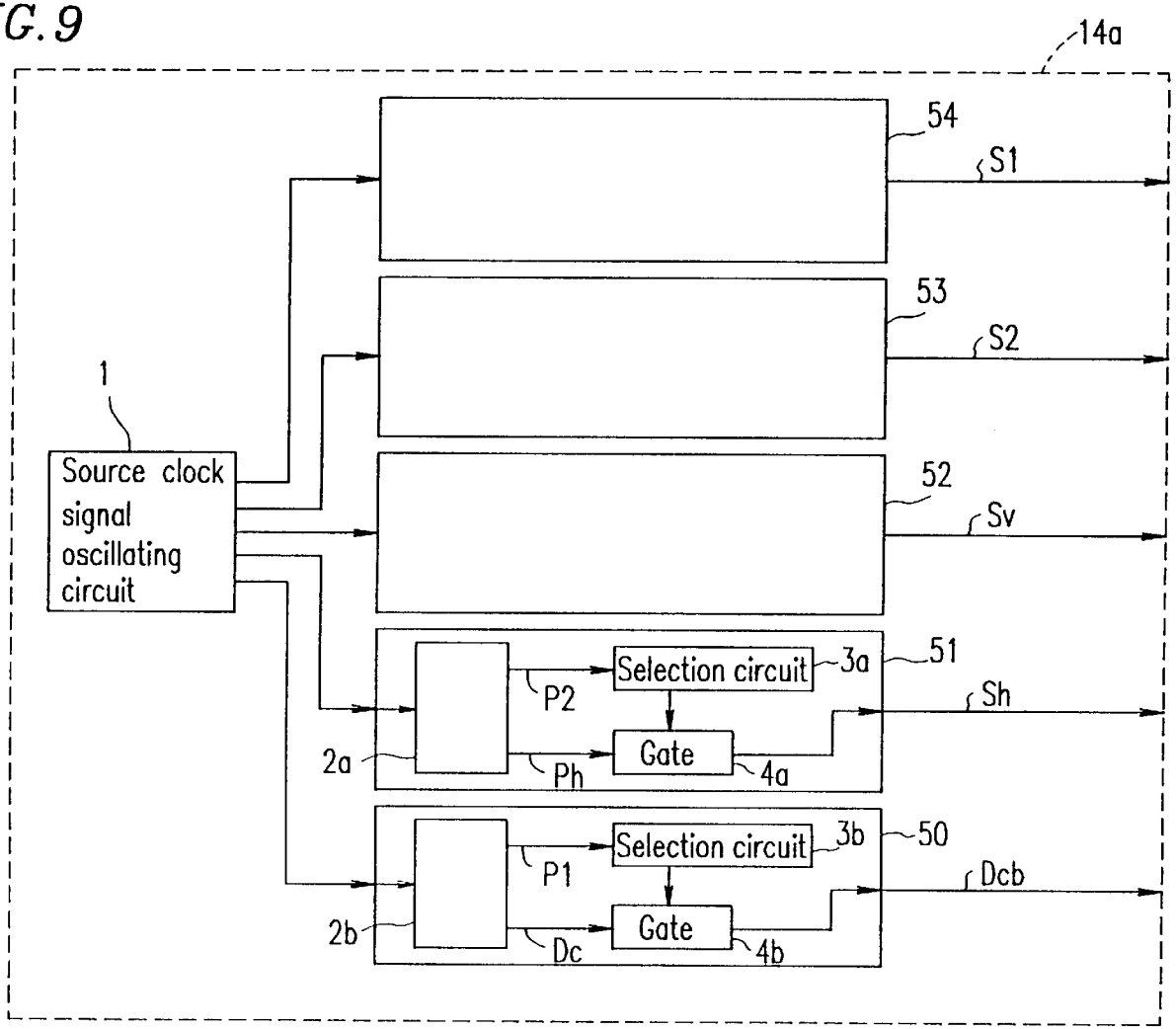
FIG. 9 is a block diagram exemplifying a timing signal generating circuit in the video signal output portion in FIG. 8.

The DAC 23 converts the digital image data to the analog video signals $V_r$, $V_g$, and $V_b$ in accordance with the timing signal S2 used as a sampling signal from the timing signal generating circuit 14*a* and outputs them. The timing signal S2 used as a sampling signal given to the DAC 23 can be used as the dot clock signal $D_c$. In this case, a signal generating circuit 50 described later in FIG. 9 is not required.

The synchronization combining circuit 10*a* is supplied with the dot clock burst signal $D_{cb}$ from the timing signal generating circuit 14*a* through an on/off switch SW. Furthermore, the synchronization combining circuit 10*a* is supplied with the horizontal synchronizing signal $S_h$. The synchronization combining circuit 10*a* superimposes the dot clock burst signal $D_{cb}$ on the horizontal synchronizing signal and outputs a combined synchronizing signal $M_a$. In the liquid crystal display apparatus 100, the combined synchronizing signal $M_a$ is utilized for determining a sampling period at which the analog signal V is converted to a digital video signal $V_D$ (see FIG. 11).

Considering the phase delay of the dot clock burst signal $D_{cb}$ at the synchronization combining circuit 10*a*, it is preferable that the dot clock burst signal $D_{cb}$ is given to the synchronization combining circuit 10*a* several clocks before the commencement of supplying the timing signal S2 used as a sampling signal to the DAC 23.

Hereinafter, the configuration of the timing signal generating circuit 14*a* will be described with reference to FIG. 9. FIG. 9 exemplifies the timing signal generating circuit 14*a* in the video signal output portion 10.

The timing signal generating circuit 14*a* includes a source clock signal oscillating circuit 1 and signal generating circuits 50 to 54. The signal generating circuits 50 to 54 generate the dot clock burst signal $D_{cb}$, the horizontal synchronizing signal $S_h$, the vertical synchronizing signal $S_v$, the timing signal S2, and the timing signal S1, respectively.

Hereinafter, an example of the signal generating circuit 50 will be described. The signal generating circuit 50 is provided with a demultiplying circuit 2*b*, a selection circuit 3*b*, and a gate 4*b*. The demultiplying circuit 2*b* receives a source clock signal output from the source clock signal oscillating circuit 1. The demultiplying circuit 2*b* demultiplies the source clock signal into a signal P1 and a dot clock signal $D_c$. The selection circuit 3*b* selects a predetermined signal from the signal P1. The gate 4*b* switches on or off a gate based on the selected signal and generates a dot clock burst signal $D_{cb}$ from the dot clock signal $D_c$.

The signal generating circuit 51, in a similar manner to the signal generating circuit 50, is provided with a demultiplying circuit 2*a*, a selection circuit 3*a*, and a gate 4*a*. The demultiplying circuit 2*a* receives a source clock signal output from the source clock signal oscillating circuit 1. The demultiplying circuit 2*a* demultiplies the source clock signal into a signal P2 and a pulse signal $P_h$. The selection circuit 3*a* selects a predetermined signal from the signal P2. The gate 4*a* switches on or off a gate based on the selected signal and generates a horizontal synchronizing signal $S_h$ from the pulse signal $P_h$.

The signal generating circuits 52 to 54 are each likewise provided with a demultiplying circuit, a selection circuit, and a gate. Because of their configurations, the signal generating circuits 52 to 54 generate the vertical synchronizing signal $S_v$, the timing signal S2, and the timing signal S1, respectively.

Figure 10A:
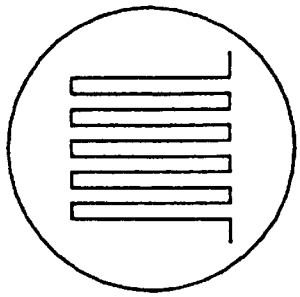
FIG. 10A is a magnified illustration of a portion of the dot clock burst signal in FIG. 10.
Figure 10:
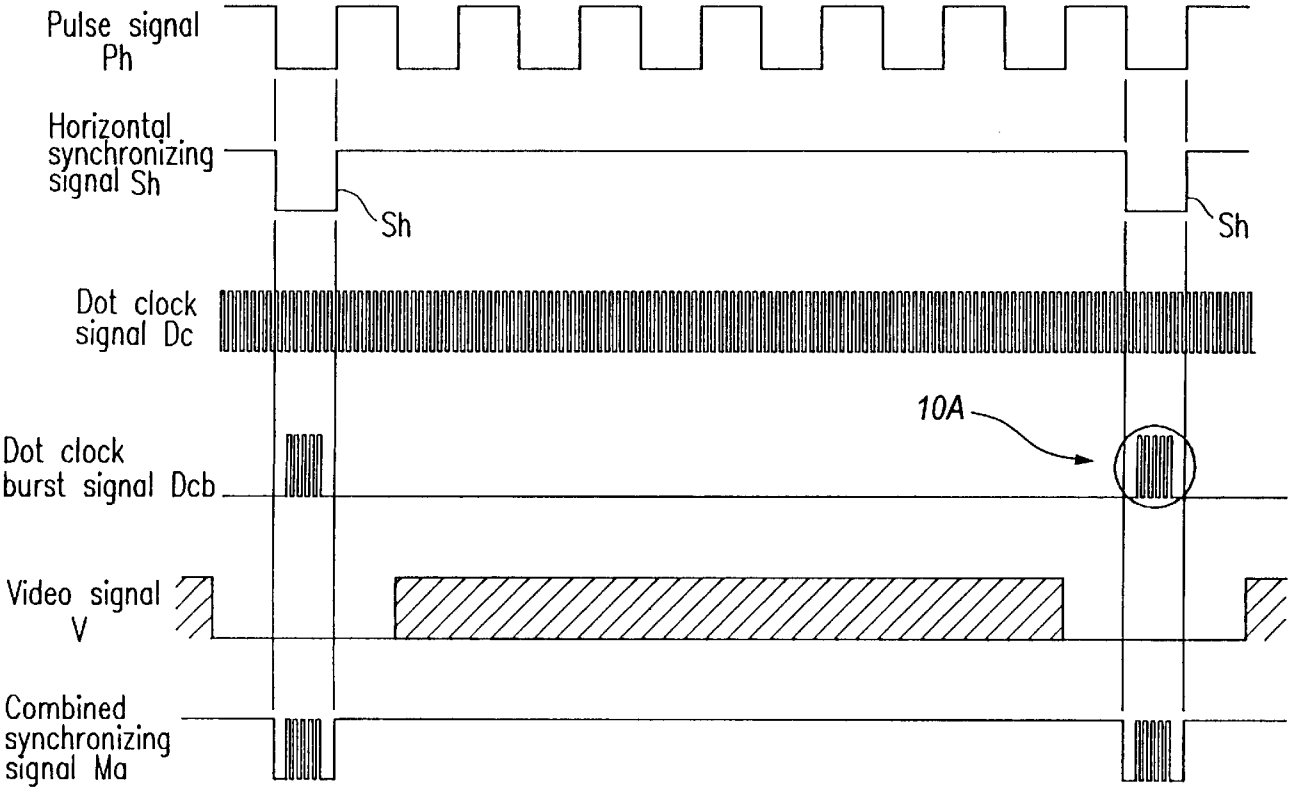
FIG. 10 is a diagram showing waveforms of a video signal V and signals generated by the signal generating circuit in FIG. 9.

FIGS. 10 and 10A shows the relationship among the pulse signal $P_h$, the horizontal synchronizing signal $S_h$, the dot clock signal $D_c$, the dot clock burst signal $D_{cb}$, the video signal V, and the combined synchronizing signal $M_a$.

Hereinafter, the configuration of the liquid crystal display apparatus used in the liquid crystal display system 1000 shown in FIG. 7 will be described with reference to FIGS. 11 and 12.

Figure 1:
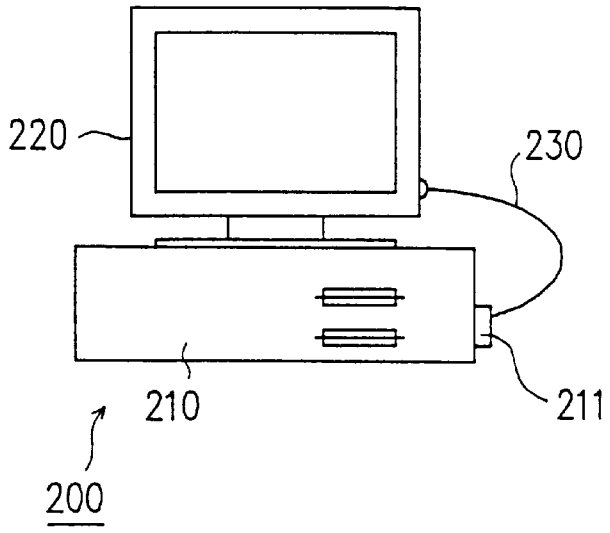
FIG. 1 is a view showing an external appearance of a PC.
Figure 2:
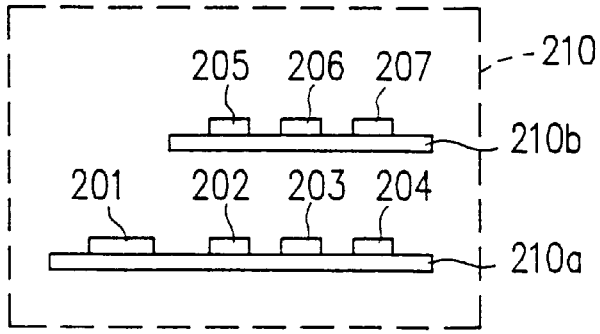
FIG. 2 is a diagram illustrating a configuration of an inside of a PC main body.
Figure 3:
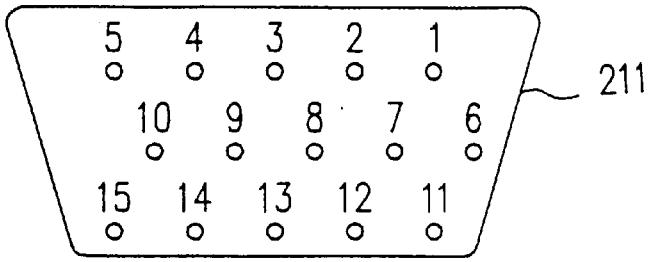
FIG. 3 is a diagram showing a configuration of a connector connecting the PC main body to a CRT display portion.
Figure 4:
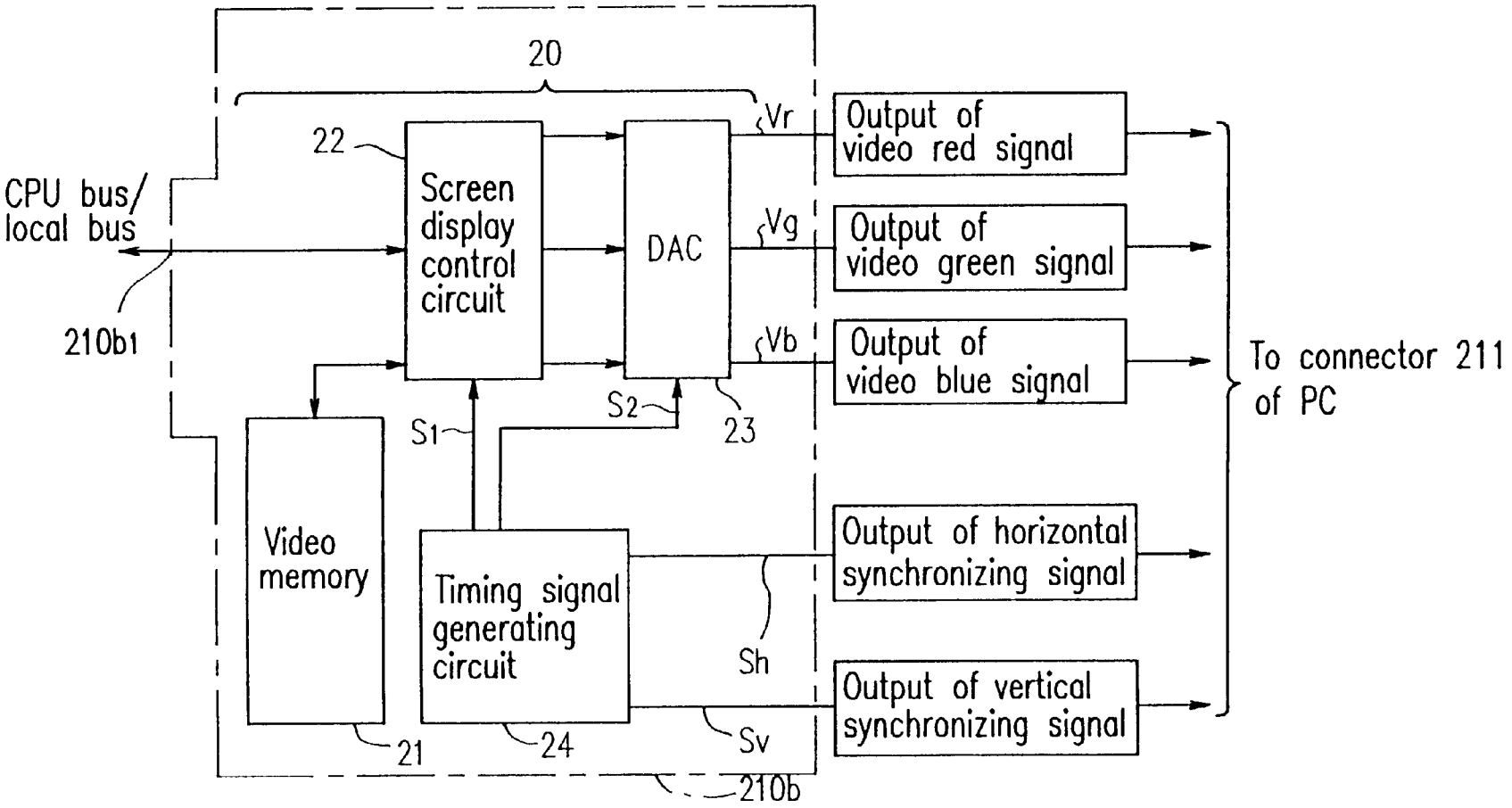
FIG. 4 is a block diagram illustrating a circuit configuration of a video signal generating portion of the PC.
Figure 5:
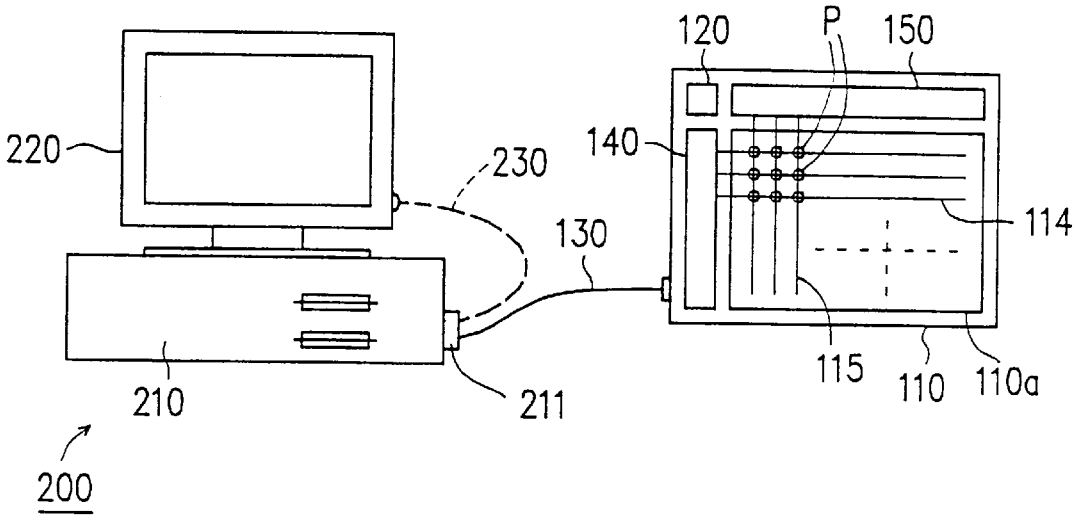
FIG. 5 is a view showing a system which displays a video display signal from the PC main body as an image by using a liquid crystal display apparatus.
Figure 6:
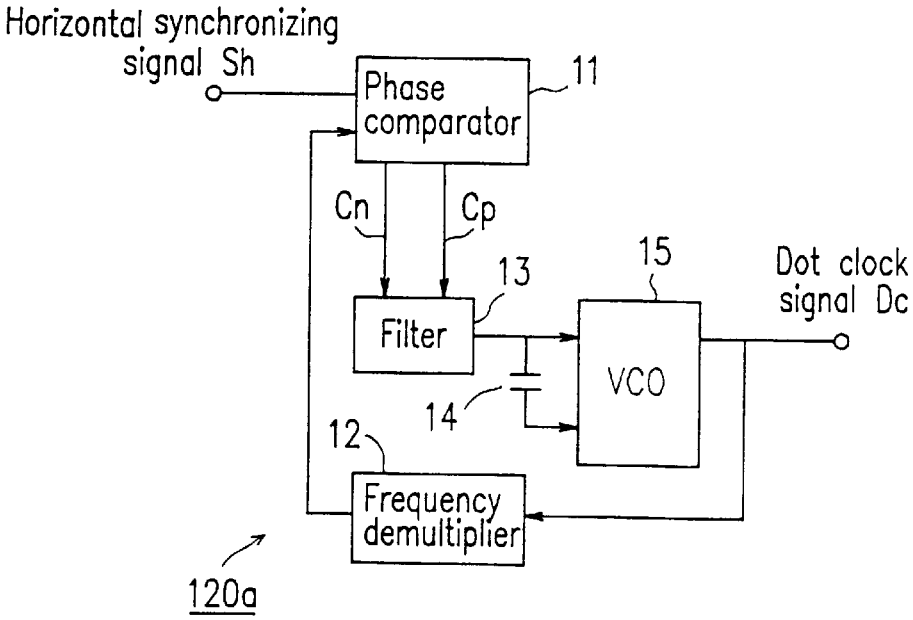
FIG. 6 is a block diagram illustrating a dot clock signal generating circuit provided on the liquid crystal panel side.

Like the liquid crystal display apparatus 110 shown in FIG. 5, the liquid crystal display apparatus 100 shown in FIG. 11 includes liquid crystal 110*a*, a scanning driver 140, and a data driver 150. The liquid crystal display apparatus 100 further includes a dividing circuit 100*a*, a display control circuit 101, and an analog-digital converter (ADC). The dividing circuit 100*a* divides the combined synchronizing signal $M_a$ supplied from the PC side into the dot clock signal $D_c$ and the horizontal synchronizing signal $S_h$.

In the liquid crystal display apparatus 100, the vertical synchronizing signal $S_v$ and the horizontal synchronizing signal $S_h$ are supplied to the scanning driver 140 through the display control circuit 101. The dot clock signal $D_c$ is also supplied to the ADC through the display control circuit 101. The ADC receives the analog video signal V, samples the analog video signal V in accordance with the dot clock signal $D_c$ in order to convert the analog video signal V to the digital video signal $V_d$. The digital video signal $V_d$ is supplied to the data driver 150.

Hereinafter, the configuration of the dividing circuit 100*a* will be described with reference to FIG. 12.

The dividing circuit 100*a* includes a horizontal synchronization extracting circuit 31 extracting the horizontal synchronizing signal $S_h$ from the combined synchronizing signal $M_a$, a burst extracting circuit 32, and an oscillating circuit 33. The horizontal synchronization extracting circuit 31 and the burst extracting circuit 32 may be circuits selecting a particular pulse width from a certain signal.

The oscillating circuit 33 outputs a signal having a frequency and a phase precisely matching with those of the dot clock burst signal $D_{cb}$ to generate the continuous dot clock signal $D_c$. The oscillating circuit 33 may be a self-oscillator having a phase control portion 33*a* and a clock oscillator 33*b*.

Hereinafter, a process for the generation of the combined synchronizing signal $M_a$ will be described.

In the source clock signal oscillating circuit 1 of the timing signal generating circuit 14*a*, a signal with a frequency twice that of the dot clock signal $D_c$ is generated as a source clock signal. The source clock signal is demultiplied to ½ by the demultiplying circuit 2*b*. The demultiplied signal is supplied to the gate 4*b* as the dot clock signal $D_c$. At this time, the gate 4*b* switches on or off the gate, based on the signal from the selection circuit 3*b* controlled by the pulse signal P1 from the demultiplying circuit 2*b*.

Then, the dot clock signal $D_c$ is input to an input terminal of the gate 4*b*. The dot clock burst signal $D_{cb}$ is obtained by periodically extracting portions of the dot clock signal $D_c$ having a plurality of rectangular waves. The period of each signal thus extracted is slightly shorter than a pulse width of the horizontal synchronizing signal. The width of the rectangular waves of the dot clock burst signal $D_{cb}$ between the extracted portions is identical to that of the rectangular waves of the dot clock signal $D_c$. The interval of the rectangular waves of the dot clock burst signal $D_{cb}$ is identical to that of the rectangular waves of the dot clock signal $D_c$.

The above-mentioned dot clock burst signal $D_{cb}$ is output from the gate 4*b*. The dot clock burst signal $D_{cb}$ is supplied to the synchronization combining circuit 10*a* through the switch SW. The on/off of the switch SW determines whether or not the dot clock burst signal $D_{cb}$ is supplied to the synchronization combining circuit 10*a*.

The gate 4*a* of the signal generating circuit 51 is supplied with the pulse signal $P_h$ having the same pulse width as the horizontal synchronizing pulse from the demultiplying circuit 2*a*. The gate 4*a* controls the on/off of the gate, based on the signal output from the selection circuit 3*a* controlled with the pulse signal P2 from the demultiplying circuit 2*a*. The pulse signal $P_h$ is input to an input terminal of the gate 4*a*, and the horizontal synchronizing signal $S_h$ is output from an output terminal of the gate 4*a*. The horizontal synchronizing signal $S_h$ is supplied to the synchronization combining circuit 10*a*.

The synchronization combining circuit 10*a* superimposes the dot clock burst signal $D_{cb}$ on the horizontal synchronizing signal $S_h$ to produce the combined synchronizing signal $M_a$. The combined synchronizing signal $M_a$ is output to the connector 211 of a PC.

The width of the horizontal synchronizing signal, and the width of a back porch and/or a front porch are varied, depending upon the kind of PC and display mode. The pulse signal width of the horizontal synchronizing signal is in the range of about 2 to 8 μsec.

In contrast, the frequency of the dot clock signal is in the range of 60 to 140 MHz in the SVGA standard, and the pulse width is almost 3 to 8 nsec (7 to 17 nsec per cycle). Thus, the pulse of the dot clock burst signal should be in the range of 8 to 10 cycles in order to perform phase control with a dot clock burst signal.

The dot clock burst signal may be superimposed in the vicinity of the rising portion of the horizontal synchronizing signal or on a portion away from the rising portion thereof. The reason for this is as follows: The duration time of the dot clock burst signal $D_{cb}$ is around 56 to 170 nsec, i.e., at most 10% of the pulse width of horizontal synchronization. In the case where the pulse width of horizontal synchronization is 2 μsec and the duration time of the dot clock burst signal is 170 nsec, the duration time of the dot clock burst signal is 8.5% of the pulse width of horizontal synchronization.

Hereinafter, a process for generating the analog video signal V will be described.

The timing signal S1 used as a sampling signal from the timing signal generating circuit 14*a* is supplied to the screen display control circuit 22. In the screen display control circuit 22, red digital image data (not shown), green digital image data (not shown), and blue digital image data (not shown) are respectively read from the video memory 21, based on the signal S1. Each of the digital image data is input to the DAC 23. In the DAC 23, the red digital image data R, the green digital image data G, and the blue digital image data B are converted into the analog video signals $V_r$, $V_g$, and $V_b$ (collectively referred to as the analog video signal V), based on the timing signal S2 used as a holding signal from the timing signal generating circuit 14*a*. The analog video signal V is output to the connector 211 of the PC.

Hereinafter, a process for displaying the analog video signal V in the liquid crystal display apparatus 100 will be described.

The analog video signal V, the combined synchronizing signal $M_a$, and the vertical synchronizing signal $S_v$ are input to the liquid crystal display apparatus 100 through the connector 211 and the analog cable 130. Referring to FIG. 11, the combined synchronizing signal $M_a$ is supplied to the dividing circuit 100*a*. The dividing circuit 100*a* divides the combined synchronizing signal $M_a$ into the horizontal synchronizing signal $S_h$ and the dot clock signal $D_c$.

In the dividing circuit 100*a*, the horizontal synchronization extracting circuit 31 shown in FIG. 12, composed of a pulse width discriminating circuit, excludes the dot clock burst signal $D_{cb}$ and extracts only the horizontal synchronizing signal $S_h$. The burst extracting circuit 32 also shown in FIG. 12, composed of a pulse width discriminating circuit, extracts only the dot clock burst signal $D_{cb}$. The horizontal synchronization extracting circuit 31 may be a pulse width discriminating circuit composed of a digital circuit. Furthermore, the horizontal synchronization extracting circuit 31 may be a low pass filter (a filter blocking a high band) composed of an analog circuit. In the case where the analog low pass filter is used, it is required to pay attention to the phase delay.

The dot clock burst signal $D_{cb}$ is supplied to the self-oscillator 33 composed of the phase control portion 33*a* and the clock oscillator 33*b*. Based on the dot clock burst signal $D_{cb}$, the dot clock signal $D_c$ is generated so as to be precisely synchronized with a holding signal of the DAC 23 of the PC. The dot clock signal $D_c$ is supplied to the data driver 150 through the display control circuit 101.

The analog video signal V is sampled by the ADC in accordance with the dot clock signal $D_c$. The digitized video signal V, i.e., a digital video signal $V_d$ is supplied to the data driver 150.

The vertical synchronizing signal $S_v$ and the horizontal synchronizing signal $S_h$ are supplied to the scanning driver 140 through the display control circuit 101.

In the present example, the dot clock burst signal generated in the video signal output portion of the PC is superimposed on the horizontal synchronizing signal and is supplied to the liquid crystal display apparatus. Therefore, it is not required to alter the specification of a connector currently used on the PC side.

Figure 13:
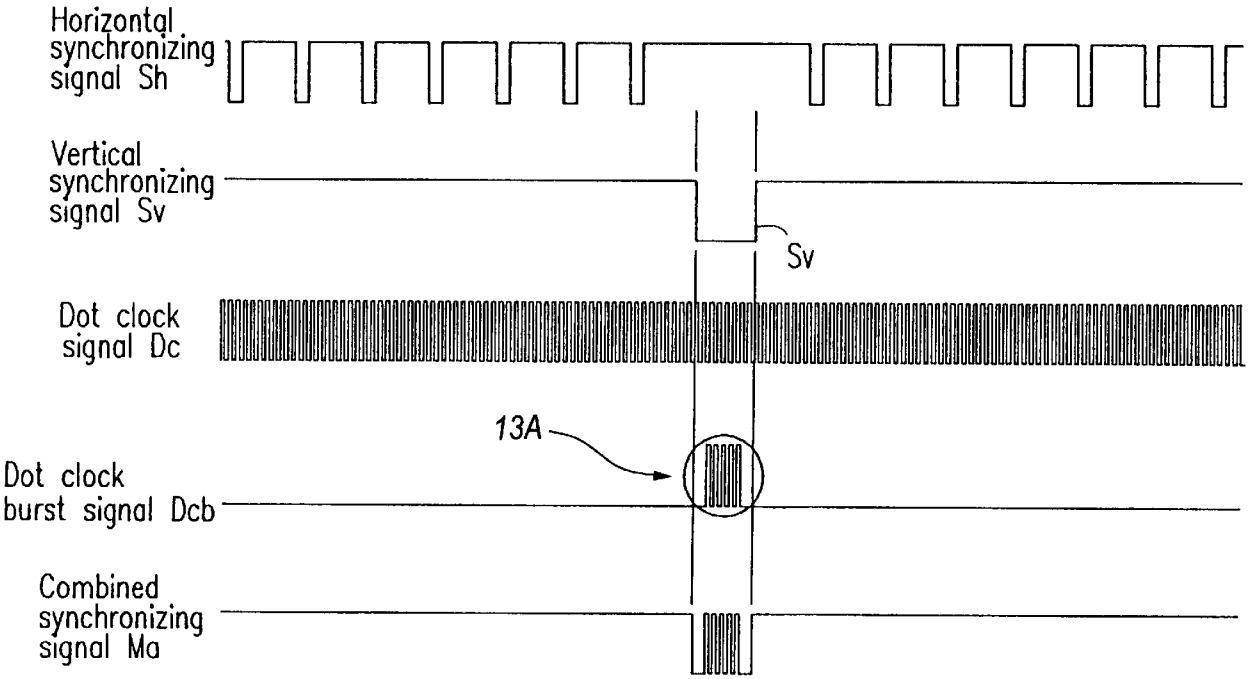
FIG. 13 is diagram showing waveforms of a vertical synchronizing signal, a dot clock signal, a burst-shaped dot clock signal (hereinafter, referred to as a dot clock burst signal), and a combined synchronizing signal.
Figure 13A:
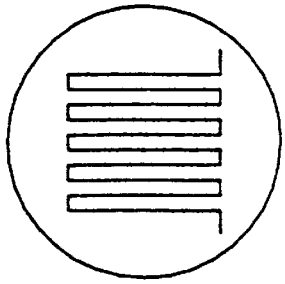
FIG. 13A is a magnified illustration of a portion of the dot clock burst signal in FIG. 13.

Although the dot clock burst signal generated in the video signal output portion in the PC is superimposed on the horizontal synchronizing signal in the present example, the same effect can also be obtained when the dot clock burst signal is superimposed on the vertical synchronizing signal as shown in FIGS. 13 and 13A. In this case, the synchronization combining circuit superimposes the vertical synchronizing signal on the dot clock burst signal $D_{cb}$.

A part of the dot clock signal generated based on the source clock signal on the PC side is supplied to the liquid crystal display apparatus, so that it is not required to generate a dot clock signal in the liquid crystal display apparatus. Furthermore, since the dot clock signal is generated on the PC side, the shift of a timing at which an analog video signal is processed on the PC side can be decreased. This enables a stable image to be displayed without flickering of dots and fluctuations of a screen.

Even in the case where the display mode in the liquid crystal display apparatus is altered or the frequency of a source clock signal is altered, a precise dot clock signal $D_c$ can be reproduced based on the dot clock burst signal from the PC.

The dot clock burst signal can be relatively easily combined with and separated from the horizontal synchronizing signal in a digital manner. The dot clock burst signal has an amplitude which changes a logical value of a logical element. The dot clock burst signal can be easily superimposed on the horizontal synchronizing signal by a logical gate.

A method for setting the amplitude of the dot clock burst signal to be superimposed on the horizontal synchronizing signal depending upon the level of changes of a logical level is suitable for extraction of the dot clock burst signal and the reproduction and processing of the horizontal synchronizing signal using a logical circuit in the liquid crystal display apparatus.

The frequency of the dot clock burst signal is higher than that of the horizontal synchronizing signal by the order of magnitude of 2 or more. This limits a period of superimposition of the dot clock burst signal on the horizontal synchronizing signal. Therefore, even when the synchronization combining signal of the dot clock burst signal and the horizontal synchronizing signal is directly supplied to the CRT display, an image to be displayed on the CRT display is hardly adversely affected.

In the case where the dot clock signal is not required, a burst signal can be stopped by the on/off switch SW on the PC side. The on/off switch SW may be an electronic switching circuit instead of a mechanical switch. In the case where it is not required to prevent a burst signal or the like from being output to the synchronization combining circuit from the timing signal generating circuit, the on/off switch SW can be omitted from the liquid crystal display system. This can also be applied to Examples 2 to 4 described later.

EXAMPLE 2

In Example 1, the dot clock burst signal in a rectangular wave is superimposed on the horizontal synchronizing signal. In the present example, the dot clock burst signal with its frequency band limited is superimposed on the horizontal synchronizing signal or the vertical synchronizing signal.

The configuration of Example 2 is similar to that of Example 1 except for the timing signal generating circuit. In Example 2, a timing signal generating circuit 14*b* is used in place of the timing signal generating circuit 14*a*.

Hereinafter, the specific configuration of the timing signal generating circuit 14*b* will be described with reference to FIG. 14. The timing signal generating circuit 14*b* includes signal generating circuits 50 to 54 and a band-liming filter 5. The configurations of the signal generating circuits 50 to 54 are the same as those of the signal generating circuits of Example 1. Therefore, the description of the operation thereof are omitted here.

The operation of the band-limiting filter 5 will be described.

A gate 4*b* opens or closes its gate in accordance with a signal from a selection circuit 3*b*. A dot clock signal $D_c$ passes through the gate 4*b* in accordance with the signal from the selection circuit 3*b* to become a dot clock burst signal $D_{cb}$. The dot clock burst signal $D_{cb}$ passes through the band-limiting filter 5.

Figure 15A:
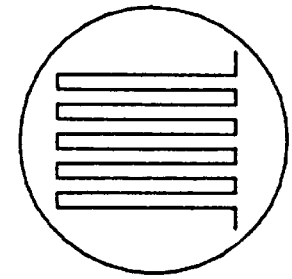
FIG. 15A is a magnified illustration of a portion of the dot clock burst signal in FIG. 15.
Figure 15B:
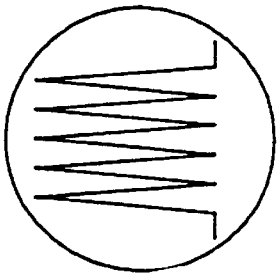
FIG. 15B is a magnified illustration of a portion of the narrow-band dot clock burst signal in FIG. 15.
Figure 15:
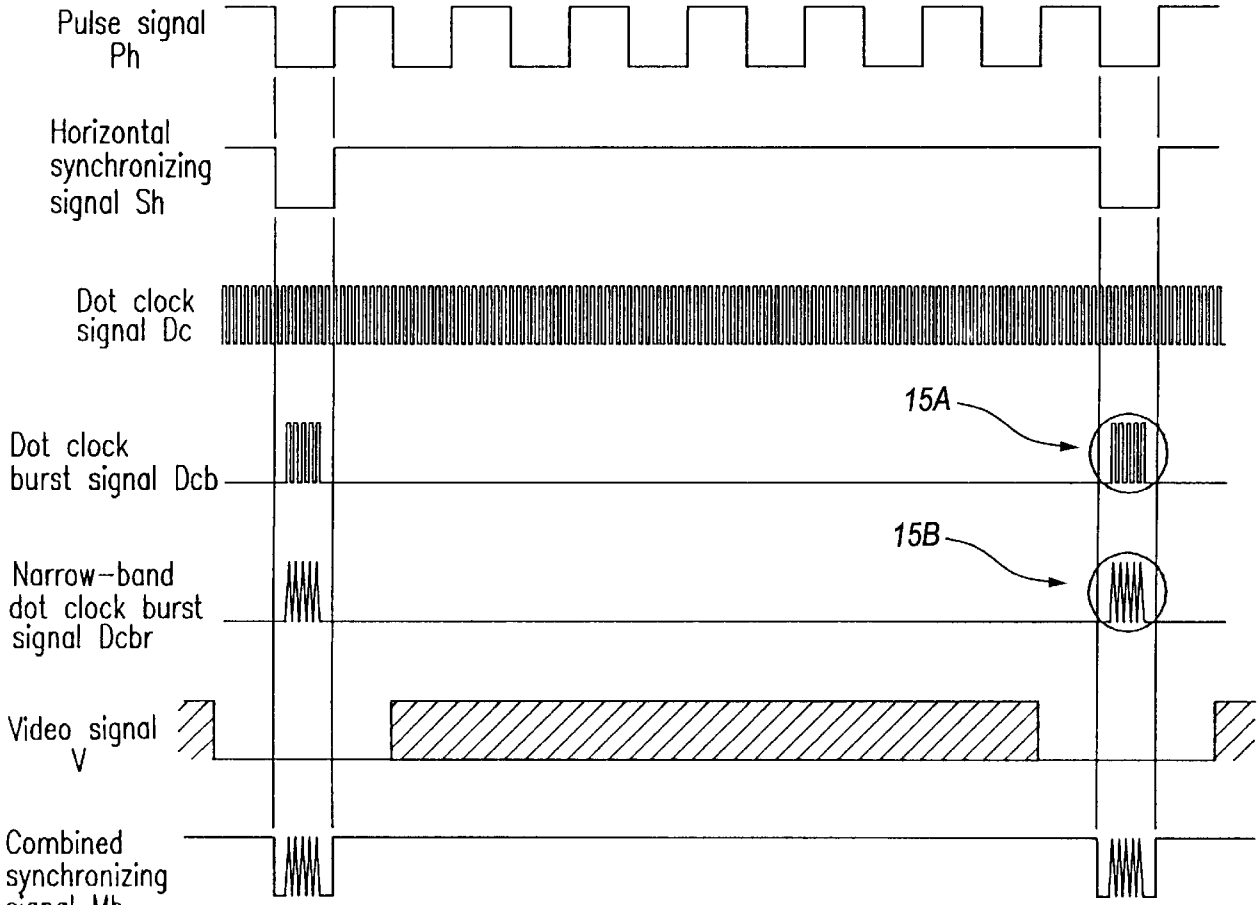
FIG. 15 is a diagram illustrating waveforms of a video signal V and signals generated by the signal generating circuit in FIG. 14.

The band-limiting filter 5 limits the frequency band of the dot clock burst signal $D_{cb}$. The dot clock burst signal $D_{cb}$ having passed through the band-liming filter 5 becomes a narrow-band dot clock burst signal $D_{cbr}$ as shown in FIGS. 15, 15A and 15B. The narrow-band dot clock burst signal $D_{cbr}$ is input to the synchronization combining circuit 10*a* in place of the dot clock burst signal $D_{cb}$.

The synchronization combining circuit 10*a* superimposes the narrow-band dot clock burst signal $D_{cbr}$ on a horizontal synchronizing signal $S_h$ to output a combined synchronizing signal $M_b$ (not shown). It is noted that the narrow-band dot clock burst signal $D_{cbr}$ may contain the second, third, fourth, and fifth harmonic waves of the basic frequency of the dot clock burst signal $D_{cb}$.

In example 2, the following effect can be obtained in addition to the effect obtained in Example 1. The dot clock signal generated on the PC is supplied to the liquid crystal display apparatus with its frequency band limited. Therefore, the dot clock signal is sent to the liquid crystal display apparatus almost in a sine wave, not in a pulse wave. This suppresses unwanted radiation from occurring while a high-speed clock signal is transmitted through a cable.

As can be seen from a color burst signal on a color TV, the effectiveness of the synchronizing signal for the reproduction of the dot clock signal does not change even when the synchronizing signal is in a sine wave, not in a rectangular wave.

The band-limiting filter 5 is composed of the combination of a high pass filter and a low pass filter so as to pass a signal with a frequency in the vicinity of the basic frequency of the dot clock signal. However, the band-limiting filter 5 can be made of a high frequency tuning circuit or a distributed constant tuning circuit composed of an inductor (L) and a capacitor (C).

In the present example, the narrow-band dot clock burst signal $D_{cbr}$ having passed through the band-limiting filter is superimposed on the horizontal synchronizing signal. However, even when the narrow-band dot clock burst signal $D_{cbr}$ is superimposed on the vertical synchronizing signal as shown in FIGS. 16, 16A and 16B the same effect can be obtained. In this case, the synchronizing combining circuit superimposes the narrow-band dot clock burst signal $D_{cbr}$ on the vertical synchronizing signal, instead of the horizontal synchronizing signal.

EXAMPLE 3

In Examples 1 and 2, the dot clock burst signal contained in the combined synchronizing signal has an amplitude which changes a logical value of a logical circuit. In Example 3, the dot clock burst signal contained in the combined synchronizing signal has an amplitude which does not change a logical value.

Hereinafter, the configuration of a liquid crystal display system in Example 3 will be described.

The configuration of the liquid crystal display system in Example 3 is the same as those of the liquid crystal display systems in Examples 1 and 2, except for the timing signal generating circuit and the synchronization combining circuit. A timing signal generating circuit and a synchronization combining circuit in Example 3 will be described with reference to FIG. 17.

Figure 14:
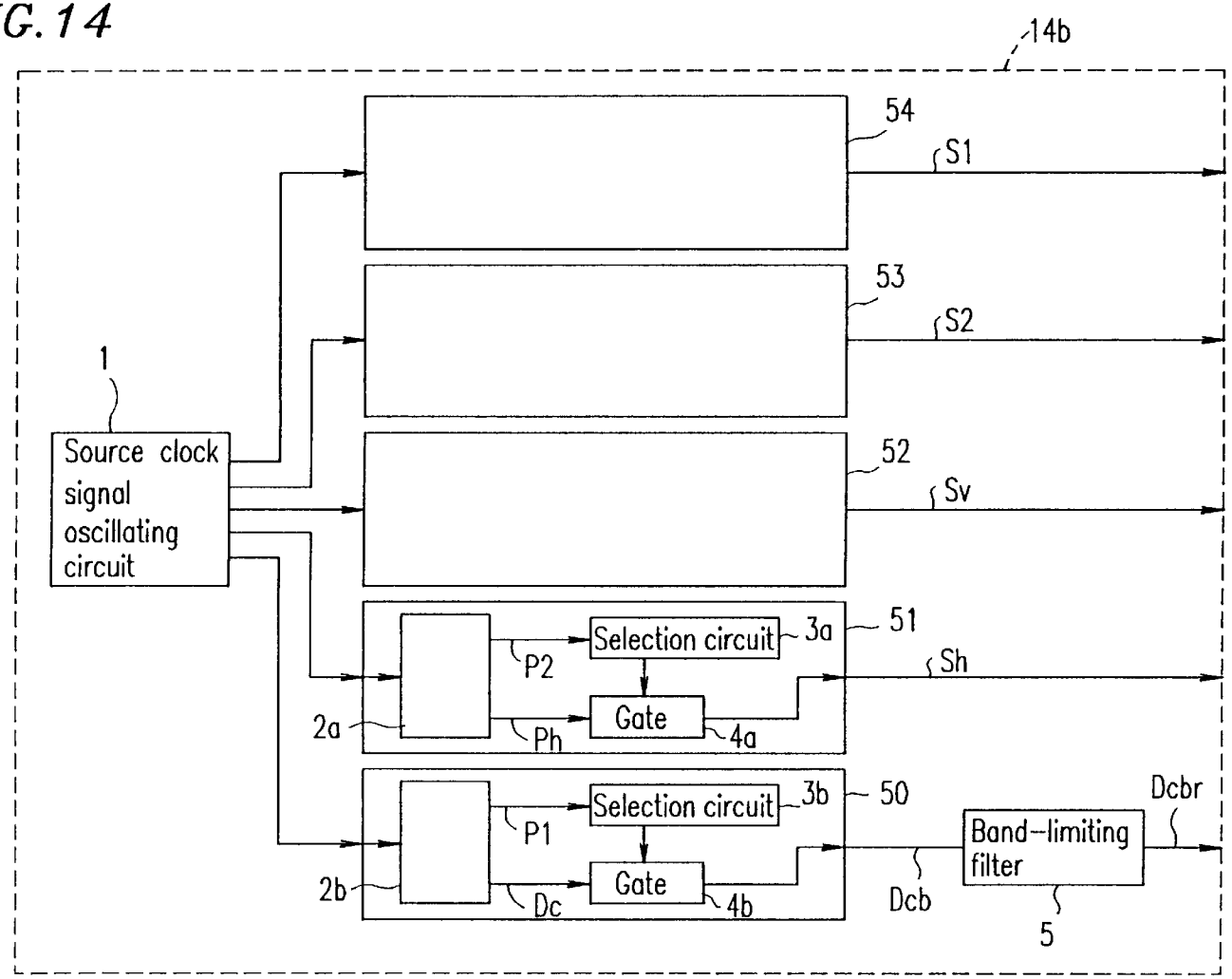
FIG. 14 is a block diagram exemplifying a timing generating circuit in the video signal output portion in FIG. 8.
Figure 17:
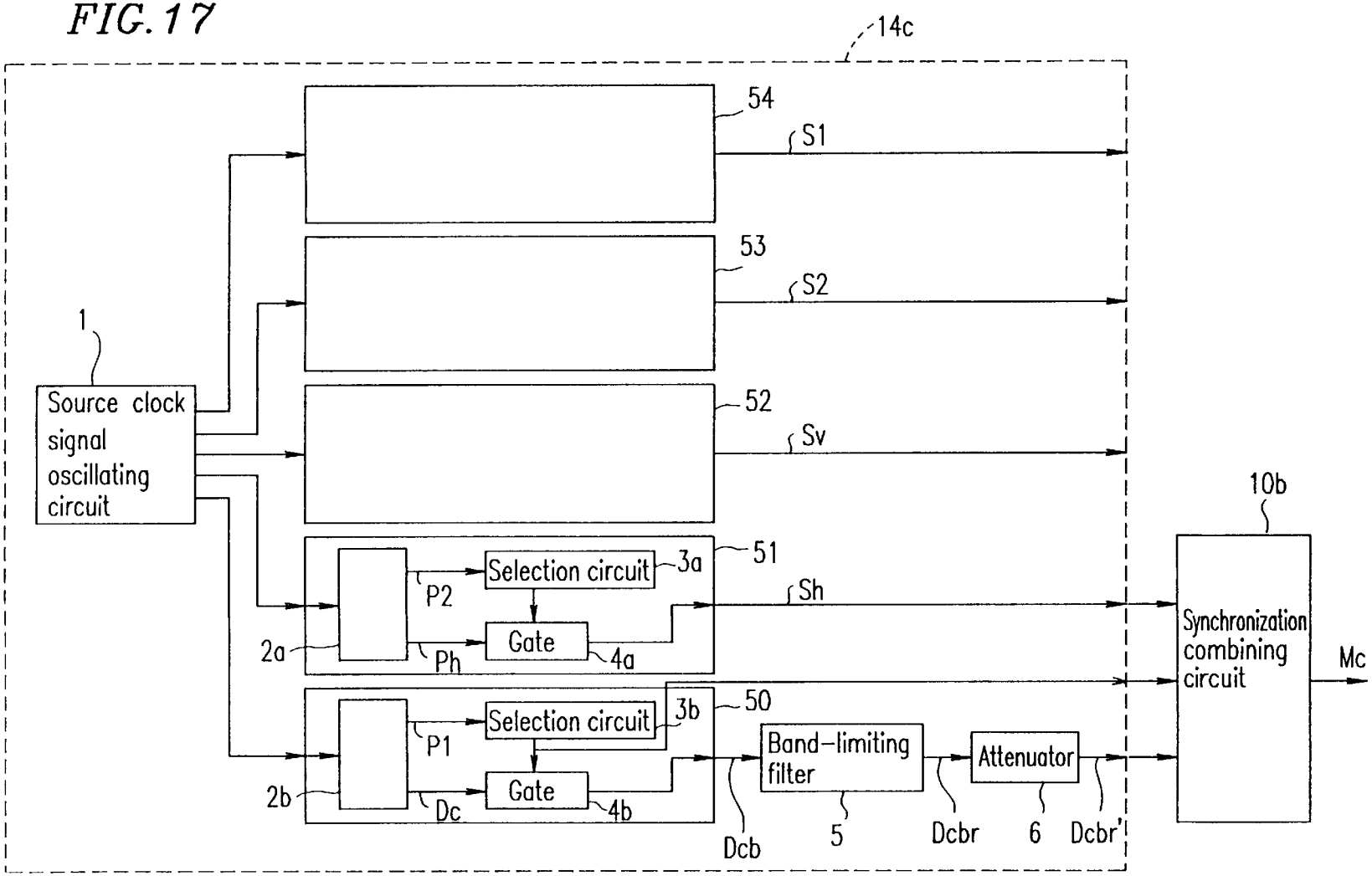
FIG. 17 is a block diagram exemplifying a timing generating circuit in the video signal output portion in FIG. 8.
Figure 19:
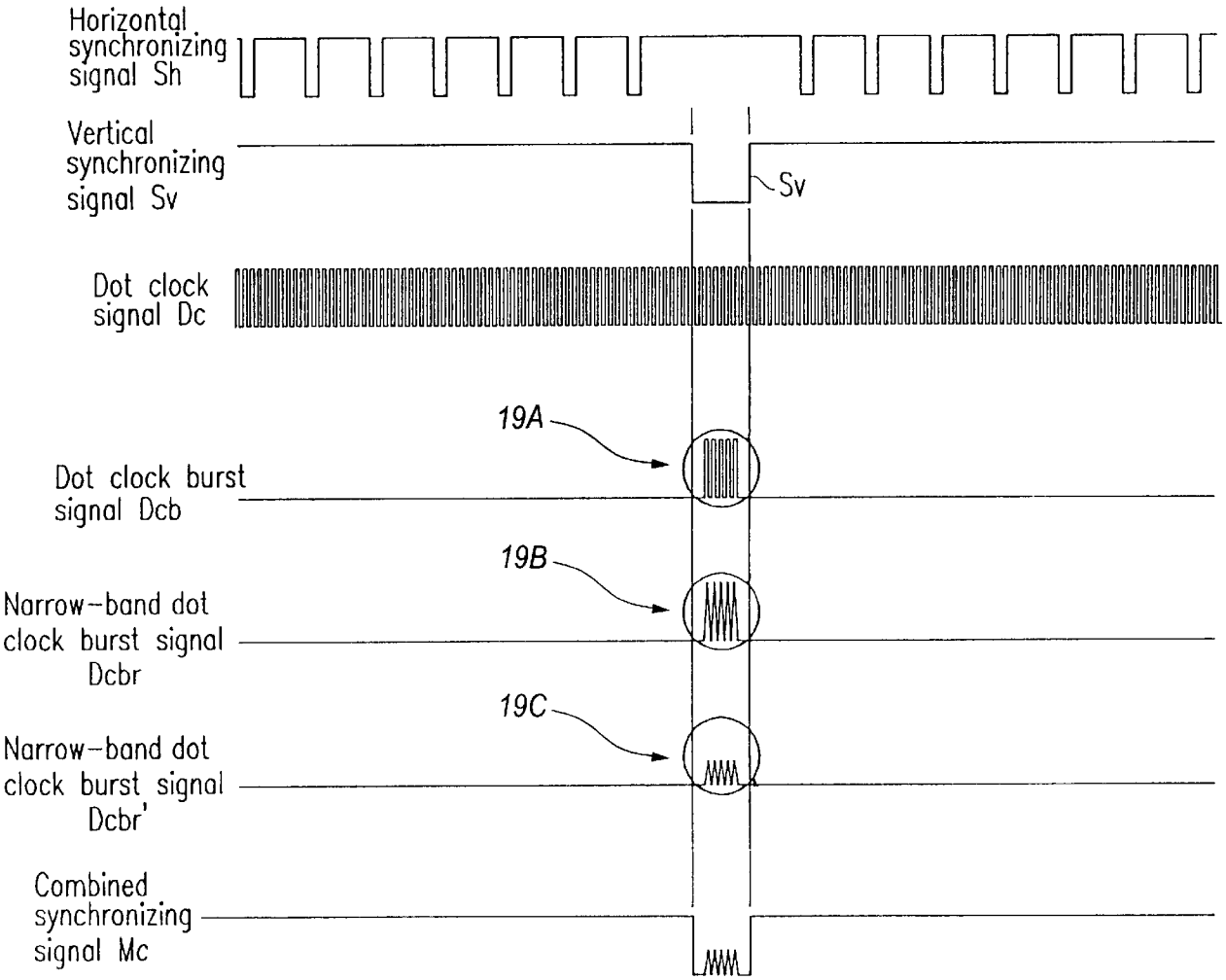
FIG. 19 is a diagram illustrating waveforms of a vertical synchronizing signal, a dot clock signal, a dot clock burst signal, narrow-band dot clock burst signals, and a combined synchronizing signal.
Figure 19A:
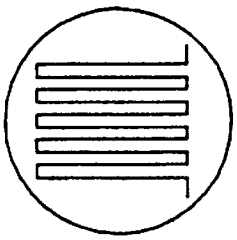
FIG. 19A is a magnified illustration of a portion of the dot clock burst signal in FIG. 19.
Figure 19B:
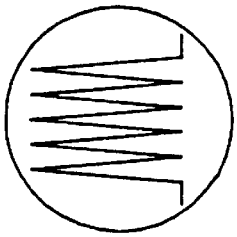
FIG. 19B is a magnified illustration of a portion of the narrow-band dot clock burst signal in FIG. 19.
Figure 19C:
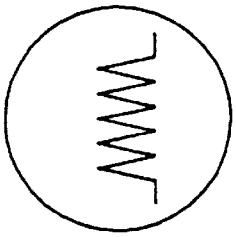
FIG. 19C is a magnified illustration of a portion of the narrow-band dot clock burst signal in FIG. 19.

In a timing signal generating circuit 14*c* shown in FIG. 17, an attenuator 6 is added to the timing signal generating circuit 14*b* shown in FIG. 14. A narrow-band dot clock burst signal $D_{cbr}$ output from a band-limiting filter 5 is supplied to the attenuator 6. Then, the amplitude of the narrow-band dot clock burst signal $D_{cbr}$ is attenuated to a predetermined level by the attenuator 6. A narrow-band dot clock burst signal $D_{cbr}'$ with its amplitude attenuated to a predetermined level is supplied to a synchronization combining circuit 10*b*. In the same way as in Examples 1 and 2, a horizontal synchronizing signal $S_h$ is input to the synchronization combining circuit 10*b*.

Furthermore, a signal is input to the synchronization combining circuit 10*b* from a selection circuit 3*b*. The impedance of a part of the synchronization combining circuit 10*b* becomes high in accordance with the signal from the selection circuit 3*b*. When the impedance of the part of the synchronization combining circuit 10*b* becomes high, the horizontal synchronizing signal $S_h$ is not output from the synchronization combining circuit 10*b*. While the impedance of the part of the synchronization combining circuit 10*b* is high, the dot clock burst signal $D_{cbr}'$ with its frequency band and amplitude limited is output from the synchronization combining circuit 10*b*.

Hereinafter, the operations of the timing signal generating circuit 14*c* and the synchronization combining circuit 10*b* shown in FIG. 17 will be described.

An output (i.e., a dot clock burst signal $D_{cb}$) of a gate 4*b* is supplied to the synchronization combining circuit 10*b* through the band-limiting filter 5 and the attenuator 6. The impedance of the part (an input terminal for a horizontal synchronizing signal) of the synchronization combining circuit 10*b* is made high in accordance with the signal from the selection circuit 3*b*. During this period, the dot clock burst signal $D_{cbr}'$ with its frequency band and amplitude limited is output from the synchronization combining circuit 10*b*. More specifically, the synchronization combining circuit 10*b* combines the dot clock burst signal $D_{cbr}'$ with the horizontal synchronizing signal $S_h$ in an analog manner. Thereafter, the combined signal is output from the synchronization combining circuit 10*b* as a combined synchronizing signal $M_c$.

In the above-mentioned combination, a bias corresponding to a central value of an amplitude of the horizontal synchronizing signal is applied to the dot clock burst signal $D_{cbr}'$. The bias should be set in such a manner that a logical circuit is not saturated on a low side of the horizontal synchronizing signal and the level of the bias does not exceed a logical threshold of the logical circuit when the dot clock burst signal $D_{cbr}'$ is superimposed on a high side of the horizontal synchronizing signal.

Regarding a standard logical circuit operating at 0 to 5 volts, when the dot clock burst signal $D_{cbr}'$ is superimposed on a low side of the horizontal synchronizing signal whose lower limit is almost 0 volt, the bias should not exceed 1 volt; and when the dot clock burst signal $D_{cbr}'$ is superimposed on a high side of the horizontal synchronizing signal whose upper limit is almost 5 volts, the bias should not be lower than 2.5 volts.

For example, when the dot clock burst signal $D_{cbr}'$ is superimposed on the horizontal synchronizing signal during a period H1 as shown in FIGS. 18, 18A, 18B and 18C the bias and the amplitude are set at about +0.3 volts and about ±0.3 volts.

When the dot clock burst signal $D_{cbr}'$ is superimposed on the horizontal synchronizing signal $S_h$ during a period H2 as shown in FIG. 18, the bias and the amplitude are set at about +4.7 volts and ±0.3 volts.

In the present example, the narrow-band dot clock burst signal $D_{cbr}'$ having passed through the attenuator is superimposed on the horizontal synchronizing signal. However, even when the narrow-band dot clock burst signal $D_{cbr}'$ is superimposed on the vertical synchronizing signal as shown in FIGS. 19, 19A, 19B, and 19C, the same effect can be obtained. In this case, the synchronization combining circuit superimposes the dot clock burst signal $D_{cbr}'$ on the vertical synchronizing signal instead of the horizontal synchronizing signal.

In the present example, the dot clock burst signal is sent to the PC with its amplitude limited to a value not exceeding a threshold of a logical circuit set on the liquid crystal display apparatus side. Therefore, the level of unwanted radiation occurring while a high frequency clock signal is transmitted through a cable can be reduced.

In the present example, since the amplitude of the dot clock burst signal is limited, the compatibility between a display signal for a CRT and that for an LCD can be maintained.

EXAMPLE 4

Hereinafter, the configuration of a liquid crystal display system of Example 4 will be described.

The configuration of the liquid crystal display system of Example 4 is the same as those of Examples 1, 2, and 3, except for the timing signal generating circuit, the synchronization combining circuit, and the dividing circuit of the liquid crystal display apparatus. A timing signal generating circuit 14*d* and a synchronization combining circuit 10*c* of Example 4 will be described with reference to FIG. 20.

Figure 20:
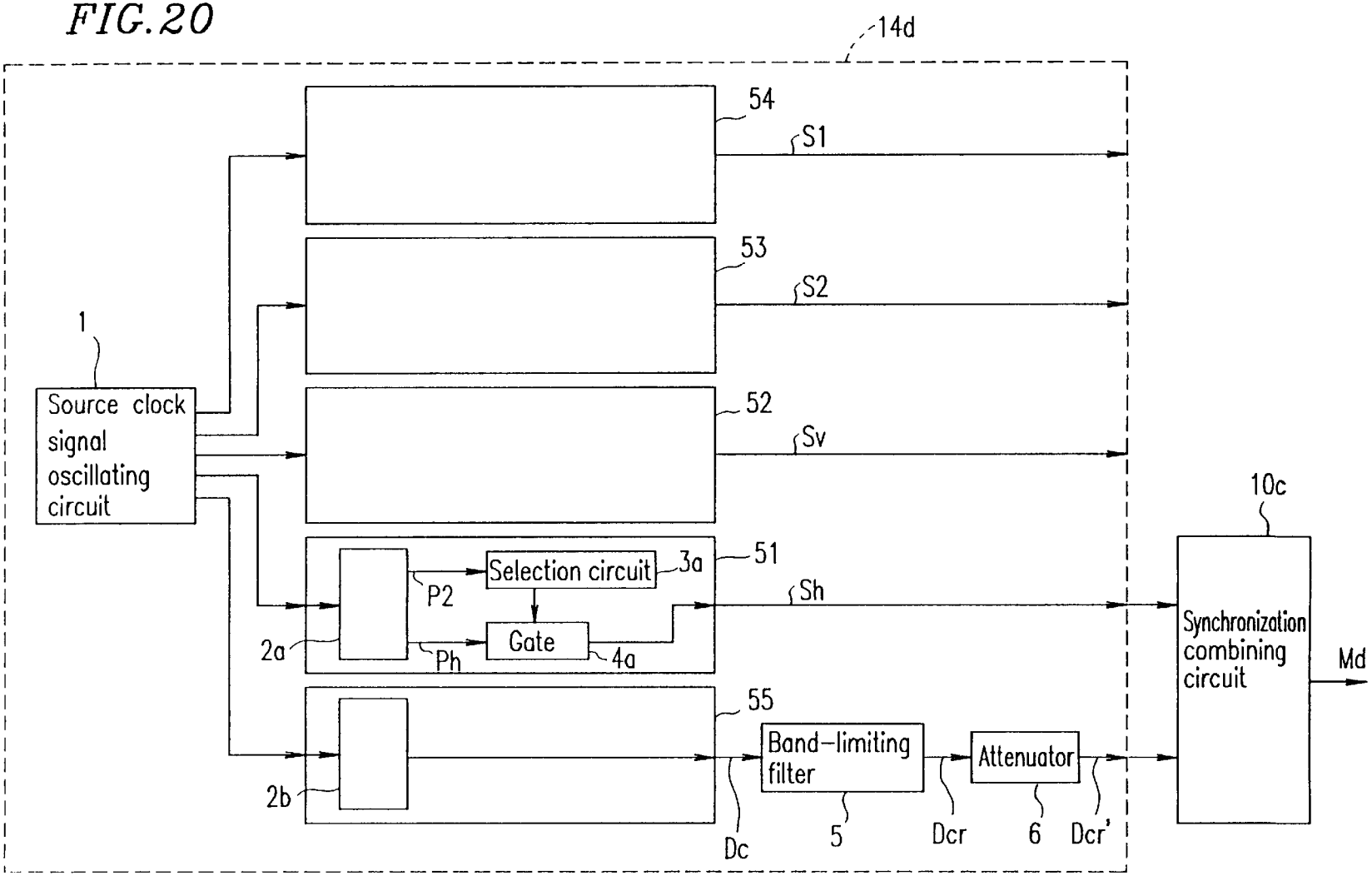
FIG. 20 is a block diagram exemplifying a timing generating circuit in the video signal output portion in FIG. 8.

The timing signal generating circuit 14*d* shown in FIG. 20 is the same as the timing signal generating circuit 14*c* shown in FIG. 17 except for the signal generating circuit 50. In Example 4, a signal generating circuit 55 is used in place of the signal generating circuit 50. The signal generating circuit 55 shown in FIG. 20 is provided with a demultiplying circuit 2*b*. The demultiplying circuit 2*b* demultiplies a source clock signal generated by a source clock signal oscillating circuit 1, and a demultiplied dot clock signal $D_c$ is output from the signal generating circuit 55.

A band-limiting filter 5 outputs a dot clock signal $D_c$ with its band limited, i.e., a narrow-band dot clock signal $D_{cr}$, to an attenuator 6.

The attenuator 6 attenuates the amplitude of the narrow-band dot clock signal $D_{cr}$ to a predetermined level. Thus, the narrow-band dot clock signal $D_{cr}'$ with its band limited to a predetermined level is supplied to the synchronization combining circuit 10*c*. The synchronization combining circuit 10*c* superimposes the narrow-band dot clock signal $D_{cr}'$ on a horizontal synchronizing signal.

Hereinafter, the operations of the timing signal generating circuit 14*d* and the synchronization combining circuit 10*c* will be described.

In Example 4, the dot clock signal $D_c$ output from the demultiplying circuit 2*b* is filtrated to the narrow-band dot clock signal $D_{cr}$ by the band-limiting filter 5. The attenuator 6 limits the amplitude of the narrow-band dot clock signal $D_{cr}$. The narrow-band dot clock signal $D_{cr}'$ with its amplitude limited is supplied to the synchronization combining circuit 10*c*. The synchronization combining circuit 10*c* superimposes the dot clock signal $D_{cr}'$ with its band and amplitude limited on the horizontal synchronizing signal in an analog manner. A combined synchronizing signal $M_d$ thus obtained is output from the synchronization combining circuit 10*c* without passing through a logical circuit.

In the above-mentioned combination, a bias corresponding to a central value of an amplitude of the horizontal synchronizing signal is applied to the dot clock signal $D_{cr}'$. The bias should be set in such a manner that a logical circuit is not saturated on a low side of the horizontal synchronizing signal and the level of the bias does not exceed a logical threshold of the logical circuit when the dot clock signal $D_{cr}'$ is superimposed on a high side of the horizontal synchronizing signal.

Regarding a standard logical circuit operating at 0 to 5 volts, when the dot clock signal $D_{cr}'$ is superimposed on a low side of the horizontal synchronizing signal whose lower limit is almost 0 volts, the bias should not exceed 1 volt; and when the dot clock signal $D_{cr}'$ is superimposed on a high side of the horizontal synchronizing signal whose upper limit is almost 5 volts, the bias should not be lower than 2.5 volts.

For example, when the dot clock signal $D_{cr}'$ is superimposed on the horizontal synchronizing signal during a period H1 as shown in FIG. 18, the bias and the amplitude are set at about +0.3 volts and about ±0.3 volts.

Figure 21:
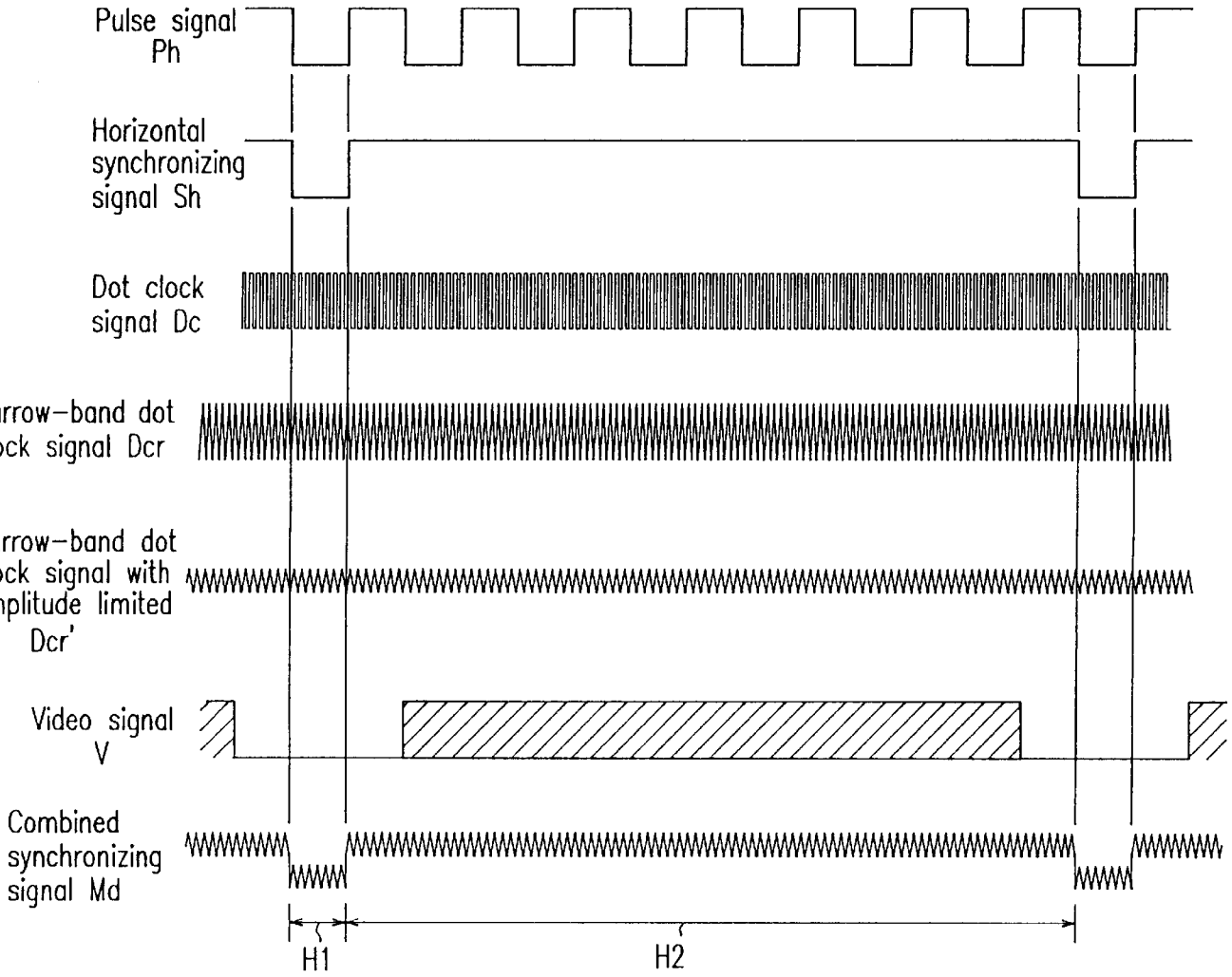
FIG. 21 is a diagram illustrating waveforms of a video signal V and signals generated by the signal generating circuit in FIG. 20.

When the dot clock signal $D_{cr}'$ is superimposed on the horizontal synchronizing signal $D_h$ during a period H2 as shown in FIG. 21, the bias and the amplitude are set at about +4.7 volts and ±0.3 volts.

Figure 22:
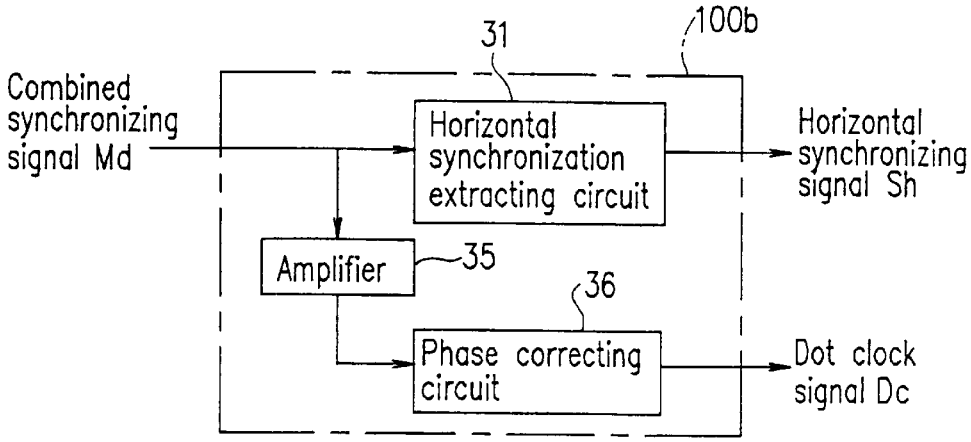
FIG. 22 is a diagram exemplifying a dividing circuit in FIG. 11.

Hereinafter, the configuration of a dividing circuit 100*b* of the liquid crystal display apparatus will be described with reference to FIG. 22.

The dividing circuit 100*b* includes a horizontal synchronization extracting circuit 31, an amplifier 35, and a phase correcting circuit 36. The horizontal synchronization extracting circuit 31 extracts the horizontal synchronizing signal $S_h$ from the combined synchronizing signal $M_d$. The horizontal synchronization extracting circuit 31 of the present example is the same as that shown in FIG. 12.

The amplifier 35 extracts the dot clock signal $D_{cr}'$ from the combined synchronizing signal $M_d$. The phase correcting circuit 36 corrects the phase of the dot clock signal $D_{cr}'$ in such a manner that the dot clock signal $D_c$ is output from a predetermined pulse counted from the rising edge of the horizontal synchronizing signal. This prevents a video signal from being displayed in a blanking period.

In the present example, the crest value of the dot clock signal is set in such a range that the change in amplitude of the combined synchronizing signal $M_d$ does not change a logical value of a logical circuit of the liquid crystal display apparatus. In the liquid crystal display apparatus, the horizontal synchronizing signal and the vertical synchronizing signal are directly taken out through the logical circuit. The dot clock signal is amplified by the amplifier 35 until the amplitude reaches a logical level, and the phase of the amplified signal is corrected by the phase correcting circuit 36.

In the case where the phase of the dot clock signal $D_c$ is delayed with respect to a video signal due to amplification or the like, the current dot clock signal $D_c$ may be delayed until its phase matches with the subsequent phase of the video signal.

The dot clock signal is generated on the PC side prior to sampling of the video signal on the liquid crystal display apparatus side, so that problems caused by the phase delay can be prevented. Such an adjustment of the phase may be conducted in the phase correcting circuit 36.

In the present example, the band of the dot clock signal $D_c$ is limited by the band-limiting filter 5. However, the dot clock signal $D_c$ may be directly supplied to the attenuator 6.

Figure 23:
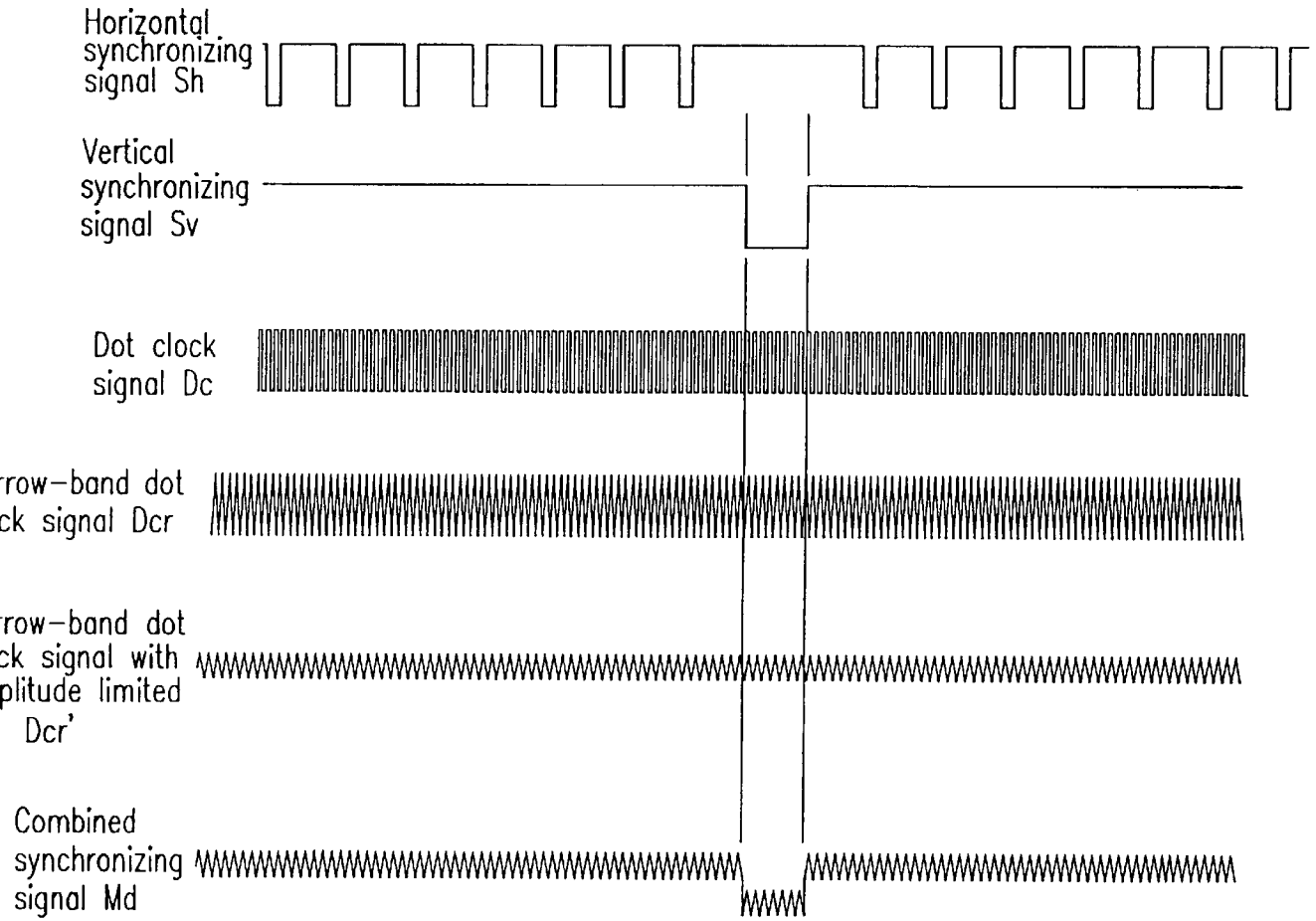
FIG. 23 is a diagram illustrating waveforms of a vertical synchronizing signal, a dot clock signal, a dot clock burst signal, narrow-band dot clock burst signals, and a combined synchronizing signal.

In the present example, the narrow-band dot clock signal $D_{cr}'$ having passed through the attenuator is superimposed on the horizontal synchronizing signal. However, even when the narrow-band dot clock signal $D_{cr}'$ is superimposed on the vertical synchronizing signal as shown in FIG. 23, the same effect can be obtained. In this case, the synchronizing combining circuit superimposes the narrow-band dot clock signal $D_{cr}'$ on the vertical synchronizing signal, instead of the horizontal synchronizing signal.

According to the liquid crystal display system of the present invention, the dot clock signal or a part thereof required on the liquid crystal display apparatus side can be supplied from the PC side. Unlike the case where the dot clock signal is generated only by very critical PLL, VCO circuits included in the liquid crystal display apparatus, the dot clock signal can be generated based on the dot clock burst signal provided on the PC side. Furthermore, the phase of the dot clock signal from the PC side can be directly corrected.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display system comprising:

an operation processing apparatus having a digital-analog converter converting a digital video signal to an analog video signal based on predetermined time information, a synchronization combining circuit superimposing the predetermined time information on at least one of a horizontal synchronizing signal and a vertical synchronizing signal, a signal generating circuit generating a dot clock burst signal, and a band-limiting filter connected between the signal generating circuit and the synchronization combining circuit; and a liquid crystal display apparatus converting the analog video signal to a digital video signal based on the predetermined time information, thereby displaying an image based on the converted digital video signal, wherein the predetermined time information is the dot clock burst signal, and wherein the band-limiting filter receives the dot clock burst signal, filtrates the dot clock burst signal so as to limit a frequency band thereof, and outputs the dot clock burst signal with the frequency band thereof limited.

2. A liquid crystal display system according to claim 1, wherein the predetermined time information is the dot clock burst signal with the frequency band thereof limited.

3. A liquid crystal display system according to claim 1, wherein the band-limiting filter includes a high pass filter and a low pass filter.

4. A liquid crystal display system according to claim 1, wherein the operation processing apparatus further includes an attenuator connected between the band-limiting filter and the synchronization combining circuit, and the attenuator limits an amplitude of the dot clock burst signal with the frequency band thereof limited.

5. A liquid crystal display system according to claim 4, wherein the predetermined time information is the dot clock burst signal with the frequency band and the amplitude thereof limited.

6. A liquid crystal display system comprising:

an operation processing apparatus having: a digital-analog converter converting a digital video signal to an analog video signal based on predetermined time information; a synchronization combining circuit superimposing the predetermined time information on at least one of a horizontal synchronizing signal and a vertical synchronizing signal; a signal generating circuit generating a dot clock signal; a band-limiting filter receiving the dot clock signal, filtrating the dot clock signal so as to limit a frequency band thereof, and outputting the dot clock signal with the frequency band thereof limited; and an attenuator limiting an amplitude of the dot clock signal with the frequency band thereof limited and outputting the dot clock signal with the frequency band and the amplitude thereof limited; and a liquid crystal display apparatus converting the analog video signal to a digital video signal based on the predetermined time information, thereby displaying an image based on the converted digital video signal.

7. A liquid crystal display system according to claim 6, wherein the predetermined time information is the dot clock signal with the frequency band and the amplitude thereof limited.

8. A liquid crystal display system according to claim 7, wherein the liquid crystal display apparatus further includes a dividing circuit extracting the predetermined time information from a signal in which the predetermined time information is superimposed on at least one of the horizontal synchronizing signal and the vertical synchronizing signal.

* * * * *